US012320051B2

(12) United States Patent
Kim et al.

(10) Patent No.: US 12,320,051 B2
(45) Date of Patent: Jun. 3, 2025

(54) WASHING MACHINE WITH DRYING FUNCTION

(71) Applicant: Samsung Electronics Co., Ltd., Suwon-si (KR)

(72) Inventors: Younghyun Kim, Suwon-si (KR); Seungil Lim, Suwon-si (KR); Heejin Kang, Suwon-si (KR); Bongjin Ko, Suwon-si (KR); Seulgi Lee, Suwon-si (KR); Jiyu Lee, Suwon-si (KR); Hyounyoung Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 181 days.

(21) Appl. No.: 18/120,049

(22) Filed: Mar. 10, 2023

(65) Prior Publication Data

US 2023/0212805 A1 Jul. 6, 2023

Related U.S. Application Data

(63) Continuation of application No. PCT/KR2022/016768, filed on Oct. 28, 2022.

(30) Foreign Application Priority Data

Dec. 30, 2021 (KR) ..... 10-2021-0193394

(51) Int. Cl.
*D06F 25/00* (2006.01)
*D06F 39/04* (2006.01)

(52) U.S. Cl.
CPC ..... *D06F 25/00* (2013.01); *D06F 39/04* (2013.01)

(58) Field of Classification Search
CPC ..... D06F 25/00
See application file for complete search history.

(56) References Cited

U.S. PATENT DOCUMENTS 7,757,521 B2 7/2010 Hong
8,191,388 B2 6/2012 Kim et al.
(Continued)

FOREIGN PATENT DOCUMENTS

JP 2017-55962 3/2017
JP 2018-82789 5/2018
(Continued)

OTHER PUBLICATIONS

International Search Report dated Feb. 9, 2023 issued in PCT Application No. PCT/KR2022/016768.
(Continued)

*Primary Examiner* — Jason Y Ko
(74) *Attorney, Agent, or Firm* — STAAS & HALSEY LLP

(57) ABSTRACT

A washing machine with drying function includes a cabinet having a laundry insertion hole; a tub having a front opening, and a back opening; a drum; and a heated air supplying device above the tub that includes an evaporator, a condenser, a heater, a heat exchange duct, an inlet, a supply duct, and a blower fan. Air from the back opening of the tub is introduced into the inlet duct and is guided by the inlet duct and received by the heat exchange duct and then passes through the heat exchange duct in a lateral direction of the tub. The air passed through the heat exchange duct is received by the supply duct and discharged by the supply duct toward a front side of the tub. The blower fan forms causes the air discharged from the supply duct to be supplied to the tub.

15 Claims, 14 Drawing Sheets

(56) References Cited

U.S. PATENT DOCUMENTS

| | | | |
|---|---|---|---|
| 8,413,471 | B2 | 4/2013 | Han et al. |
| 9,091,014 | B2 | 7/2015 | Park et al. |
| 9,677,215 | B2 | 6/2017 | Kim et al. |
| 9,746,238 | B2 | 8/2017 | Lim et al. |
| 2020/0299892 | A1 | 9/2020 | Hahm et al. |

FOREIGN PATENT DOCUMENTS

| | | |
|---|---|---|
| JP | 2020-130844 | 8/2020 |
| KR | 10-0465192 | 1/2005 |
| KR | 10-0634934 | 10/2006 |
| KR | 10-0697083 | 3/2007 |
| KR | 10-0754876 | 9/2007 |
| KR | 10-0857799 | 9/2008 |
| KR | 10-0971112 | 7/2010 |
| KR | 10-2011-0080620 | 7/2011 |
| KR | 10-1196984 | 11/2012 |
| KR | 10-1234074 | 2/2013 |
| KR | 10-2014-0099055 | 8/2014 |
| KR | 10-1795770 | 11/2017 |
| KR | 10-2129793 | 7/2020 |
| KR | 10-2138677 | 7/2020 |
| KR | 10-2020-0112166 | 10/2020 |
| KR | 10-2021-0087388 | 7/2021 |
| WO | WO 2018/066805 A1 | 4/2018 |

OTHER PUBLICATIONS

Written Opinion dated Feb. 9, 2023 issued in PCT Application No. PCT/KR2022/016768.

European Search Report dated Jan. 8, 2025, in European Patent Application No. 22916359.7.

WASHING MACHINE WITH DRYING FUNCTION

CROSS-REFERENCE TO RELATED APPLICATIONS

This application is a continuation application of International Application No. PCT/KR2022/016768 designating the United States, filed on Oct. 28, 2022, in the Korean Intellectual Property Receiving Office and claiming priority to Korean Patent Application No. 10-2021-0193394, filed on Dec. 30, 2021, in the Korean Intellectual Property Office, the disclosures of which are incorporated by reference herein in their entireties.

BACKGROUND

1. Field

The disclosure relates to a washing machine, and more particularly to a washing machine with drying function capable of washing and drying laundry.

2. Description of Related Art

In general, washing machines which wash laundry and dryers which dry laundry are formed as separate devices.

Accordingly, consumers dry laundry which has completed washing by using a dryer after washing the laundry using a washing machine.

However, in cases where the washing machine and the dryer are formed as separate devices as described above, there is an inconvenience of a user having to wait until the laundry is completed and then move the laundry which has completed washing to the dryer.

To solve the inconvenience described above, a washing machine with drying function has been developed and is being used.

However, the washing machine with drying function of the related art has a problem of the drying function being relatively weaker compared to a dryer having only the drying function.

SUMMARY

According to an embodiment, a washing machine with drying function may include a cabinet having a laundry insertion hole at a front surface of the cabinet; a tub, inside the cabinet having a front opening so that laundry is insertable through the laundry insertion hole and then through the front opening to be received into the tub, and a back opening; a drum rotatably disposed inside the tub; and a heated air supplying device above the tub and including: an evaporator, a condenser, a heater, a heat exchange duct in which the evaporator and the condenser are disposed, an inlet duct at one side of the heat exchange duct, a supply duct at an opposite side of the heat exchange duct than the inlet duct and in which the heater is disposed, and a blower fan at a front side of the tub. The heat exchange duct, the inlet duct, the supply duct, and the blower fan are configured so that air from the back opening of the tub is introduced into the inlet duct and is guided by the inlet duct, the air guided by the inlet duct is received by the heat exchange duct and then passes through the heat exchange duct in a lateral direction of the tub, the air passed through the heat exchange duct is received by the supply duct and discharged by the supply duct in a direction toward a front side of the tub, and the blower fan forms an airflow that causes the air discharged from the supply duct to be supplied to the front opening.

The heater may be fixed to a side surface of the supply duct.

The washing machine with drying function may include a heater bracket that is installed on a lower surface of the supply duct and that supports the heater.

The washing machine with drying function may include a barrier on an inner surface of the supply duct.

The washing machine with drying function may include a barrier groove on the inner surface of the supply duct, and the barrier may be configured to be installed in the barrier groove.

The barrier may include: an upper barrier covering an upper surface of the supply duct; a side barrier covering a side surface of the supply duct; and a lower barrier covering a lower surface of the supply duct.

The barrier may be spaced apart from the inner surface of the supply duct.

The barrier may be spaced apart from a bottom of the barrier groove.

The barrier may include a metal material.

The heater may include a sheath heater.

The supply duct may include: a supply duct body to which the heater can be installed, and a supply duct cover covering an upper surface of the supply duct body and that is separable from the supply duct body.

According to an embodiment, a washing machine with drying function may include: a cabinet having a laundry insertion hole at a front surface of the cabinet; a cylindrical tub, inside the cabinet, having a front opening so that laundry is insertable through the laundry insertion hole and then through the front opening to be received into the tub, and a back opening; a diaphragm configured to connect the laundry insertion hole with the front opening of the tub; a drum rotatably disposed inside the tub; and a heated air supplying device including: an evaporator, a condenser, a heater, a heat exchange duct in which the evaporator and the condenser are disposed, an inlet duct at one side of the heat exchange duct, a supply duct at an opposite side of the heat exchange duct than the inlet duct, a barrier at an inner surface of the supply duct, a heater inside the supply duct and spaced apart from the barrier, and a blow duct at a front side of the tub connecting the supply duct to the diaphragm. The heat exchange duct, the inlet duct, the supply duct, and the blow duct are configured so that air from the back opening of the tub is introduced into the inlet duct and is guided by the inlet duct, the air guided by the inlet duct is received by the heat exchange duct and then passes through the heat exchange duct in a lateral direction of the tub, the air passed through the heat exchange duct is received by the supply duct and discharged by the supply duct in a direction toward a front side of the tub.

The washing machine with drying function may further include a heater bracket that is installed on a lower surface of the supply duct and that supports the heater.

The washing machine with drying function may further include a barrier groove on an inner surface of the supply duct and to which the barrier is fixed.

The barrier may be spaced apart from a bottom of the barrier groove.

The barrier may further include: an upper barrier covering an upper surface of the supply duct; a side barrier covering a side surface of the supply duct; and a lower barrier covering a lower surface of the supply duct.

BRIEF DESCRIPTION OF THE DRAWINGS

Aspects, features, and advantages of certain embodiments of the present disclosure will be more apparent from the following description taken in conjunction with the accompanying drawings, in which.

DETAILED DESCRIPTION

Descriptions below, which takes into reference the accompanying drawings, is provided to assist in a comprehensive understanding of various embodiments of the disclosure as defined by the claims and its equivalent. Although various specific details are included to assist in the understanding herein, the above are to be understood as merely example embodiments. Accordingly, it will be understood by those of ordinary skill in the art that various modifications may be made to various embodiments described herein without departing from the scope and spirit of the disclosure. In addition, descriptions on well-known functions and configurations will be omitted for clarity and conciseness.

Terms and words used in the description below and in the claims are not limited to its bibliographical meaning, and are used merely to assist in a clear and coherent understanding of the disclosure. Accordingly, the description below on the various embodiments of the disclosure are provided simply as examples and it will be clear to those of ordinary skill in the art that the example embodiments as defined by the appended claims and its equivalent are not for limiting the disclosure.

Terms such as first and second may be used in describing various elements, but the elements are not limited by the above-described terms. The above-described terms may be used only for the purpose of distinguishing one element from another element. For example, a first element may be designated as a second element, and likewise, a second element may be designated as a first element without exceeding the scope of protection.

The terms used in the embodiments of the disclosure may be interpreted to have meanings generally understood to one of ordinary skill in the art unless otherwise defined.

In addition, terms such as 'tip end,' 'back end,' 'upper part,' 'lower part,' 'upper end,' 'lower end,' and the like used in the disclosure may be defined based on the drawings, and forms and locations of each element are not limited by these terms.

A washing machine with drying function according to an embodiment will be described in detail below with reference to the accompanied drawings.

Figure 1:
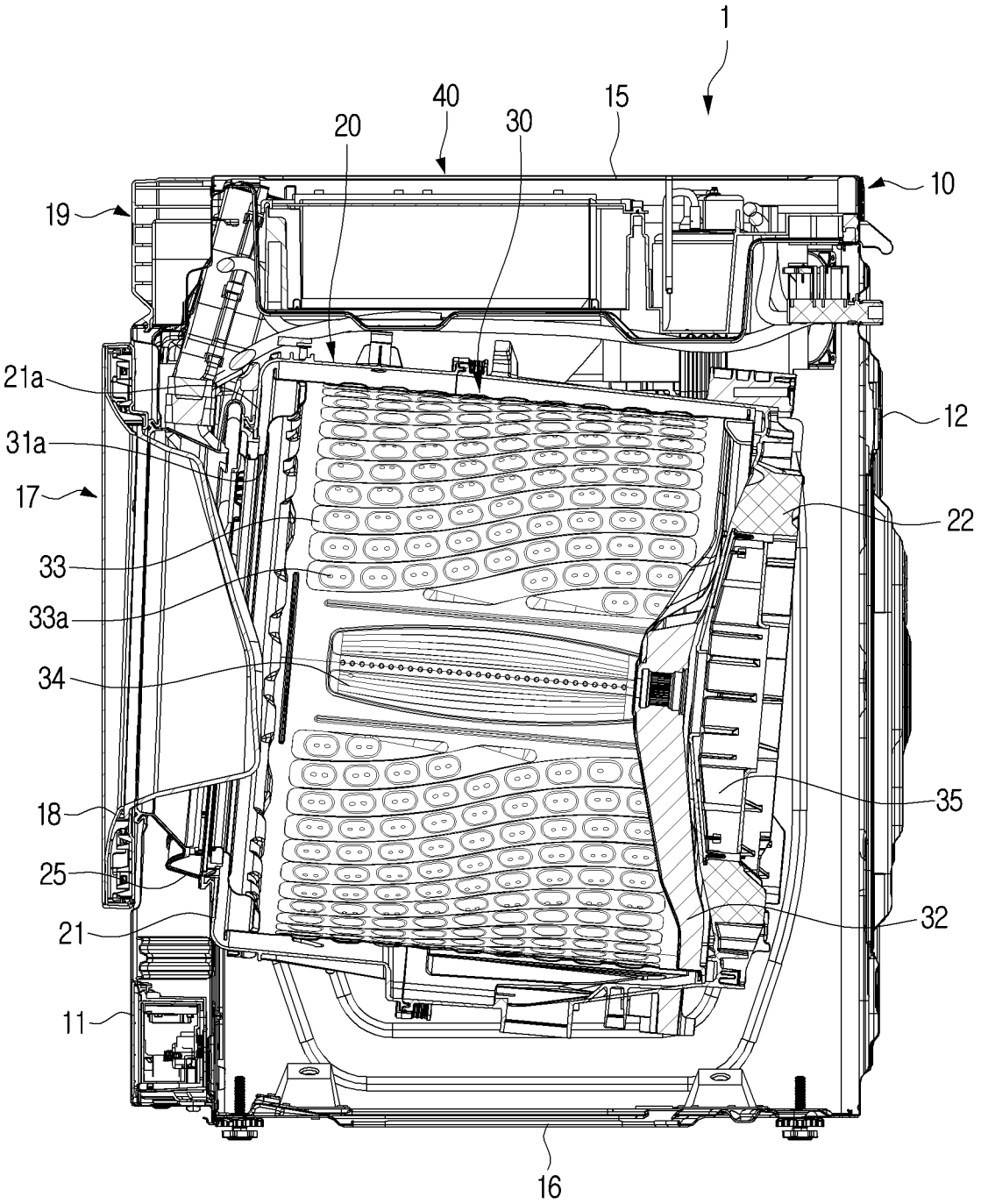
FIG. 1 is a cross-sectional view illustrating a washing machine with drying function according to an embodiment.

FIG. 1 is a cross-sectional view illustrating a washing machine with drying function according to an embodiment.

Referring to FIG. 1, the washing machine with drying function 1 according to an embodiment may include a cabinet 10, a tub 20, a drum 30, and a heated air supplying device 40.

The cabinet 10 may form an exterior of the washing machine with drying function 1, and may be formed roughly in a rectangular parallelepiped shape. The cabinet 10 may include a front surface cover 11, a back surface cover 12, a left-side cover 13 (referring to FIG. 2), a right-side cover 14 (referring to FIG. 2), an upper cover 15, and a lower cover 16.

At a front surface of the cabinet 10, a laundry insertion hole 18 may be provided to load and unload laundry to an inside of the cabinet 10. That is, the laundry insertion hole 18 may be formed at the front surface cover 11 of the cabinet 10.

At the laundry insertion hole 18, a door 17 may be installed so as to be openable and closeable. At an upper part of the front surface cover 11 of the cabinet 10, a control panel 19 which may control the washing machine 1 may be provided. The control panel 19 may include a plurality of buttons for controlling the washing machine 1, a display to show the washing machine 1 and information associated with a washing process, and a processor configured to control the washing machine.

The tub 20 may be installed at the inside of the cabinet 10, and may be formed in a hollow cylindrical shape on which a front opening 21*a* is provided toward the laundry insertion hole 18 of the front surface cover 11. The front opening 21*a* of the tub 20 may be formed to have a size corresponding to the laundry insertion hole 18. At a back end of the tub 20, a back surface plate 22 may be provided. At the back surface plate 22, a back opening 22*a* through which air inside the tub 20 is discharged may be provided.

The tub 20 may contain washing water of a predetermined amount necessary in washing. The tub 20 may be supported and fixed at an inner surface of the cabinet 10 by a tension spring, an oil damper, and the like.

Between the tub 20 and the front surface cover 11 of the cabinet 10, a diaphragm 25 may be installed. The diaphragm 25 may be formed roughly in an annular shape. One end of the diaphragm 25 may be fixed to a front surface 21 of the tub 20 at which the front opening 21*a* is provided, and the other end of the diaphragm 25 may be fixed to an inner circumference of the laundry insertion hole 18 of the front surface cover 11 of the cabinet 10.

The diaphragm 25 may be configured such that the washing water contained in the tub 20 is not leaked to an outside of the tub 20, and may form a pathway through which the laundry passes. In addition, the diaphragm 25 may block vibration which is generated when the drum 30 is rotated from being transferred to the front surface cover 11 of the cabinet 10 through the tub 20.

The drum 30 may be installed at an inside of the tub 20 to be rotatable, and may be formed roughly in a hollow cylindrical shape. At a front surface of the drum 30, a drum opening 31*a* corresponding to the laundry insertion hole 18 of the cabinet 10 and the front opening 21*a* of the tub 20 may be provided, and at a back end of the drum 30, a back surface plate 32 may be provided.

At a side surface 33 of the drum 30, a plurality of through-holes 33*a* through which the washing water may pass may be provided. The back surface plate 32 of the drum 30 may be provided with a plurality of through-holes. Accordingly, air inside the drum may be discharged to a space between the drum 30 and the tub 20 through the plurality of through-holes 33*a* formed at the side surface 33 of the drum 30 and the plurality of through-holes formed at the back surface plate 32.

In addition, at an inner circumferential surface of the drum 30, a plurality of lifts 34 which may raise the laundry may be provided. The drum 30 may rotate about a central axis by a driving device which includes a driving motor 35 installed at the back surface plate 32.

A water supply device for supplying water to the tub 20 may be provided above the tub 20, and a water draining device for draining water from the tub 20 to the outside may be disposed below the tub 20.

The water supplying device may include a water supply pipe connected with an external water supply source and a water supply valve which opens and closes the water supply pipe. One end of the water supply pipe may be connected to the diaphragm 25. The water supply pipe may be provided with a detergent intake part.

The water draining device may be formed to discharge the washing water contained in the tub 20 to the outside of the washing machine with drying function 1. The water draining device may be installed below the tub 20, and include a pump and a water drain pipe. When the pump is operated, the washing water contained in the tub 20 may be discharged to the outside of the washing machine 1 through the water drain pipe.

At an upper side of the tub 20, the heated air supplying device 40 may be installed to dry the laundry which was washed by a rotation of the drum 30. The heated air supplying device 40 may be formed to generate heated air by heating and drying air which is discharged from the tub 20 and to circulate the heated air through the inside of the tub 20 so as to dry the laundry which is located at an inside of the drum 30. In the description below, heated air may refer to air which is heated and dried by the heated air supplying device 40.

The heated air supplying device 40 according to an embodiment will be described in detail below with reference to FIGS. 2 to 5.

Figure 2:
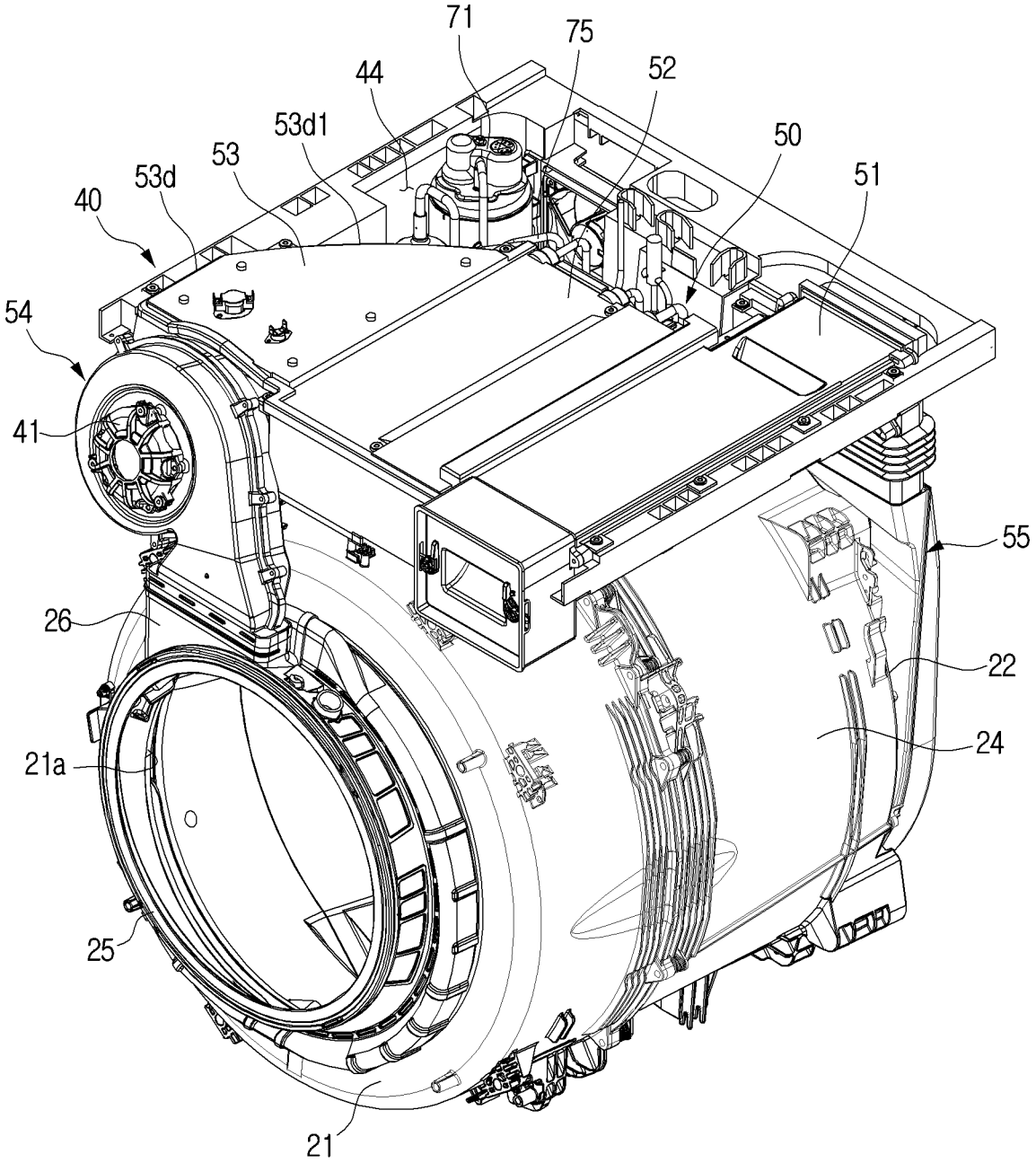
FIG. 2 is a perspective view illustrating a heated air supplying device of a washing machine with drying function according to an embodiment.
Figure 3:
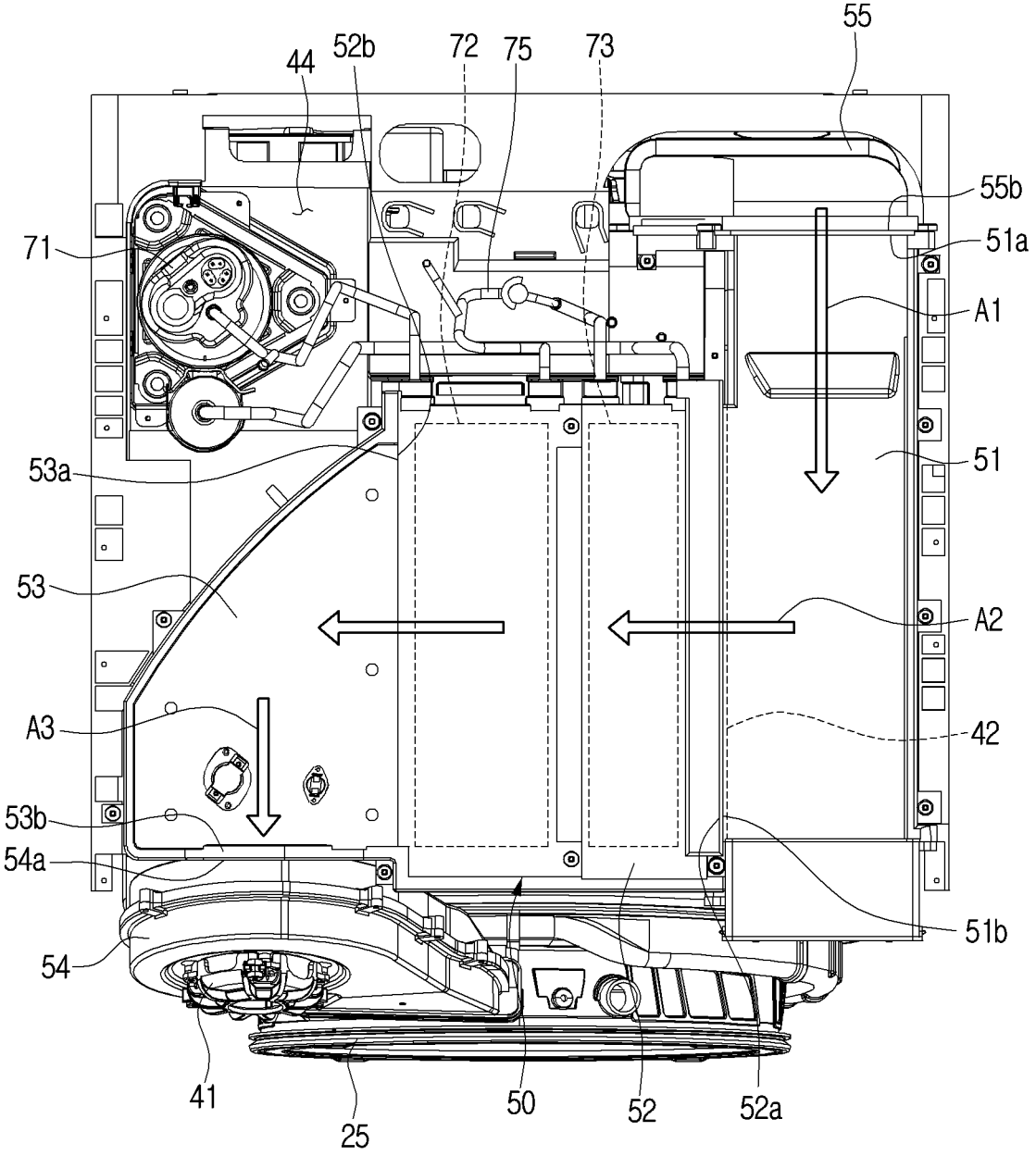
FIG. 3 is a plane view illustrating a heated air supplying device of a washing machine with drying function according to an embodiment.
Figure 4:
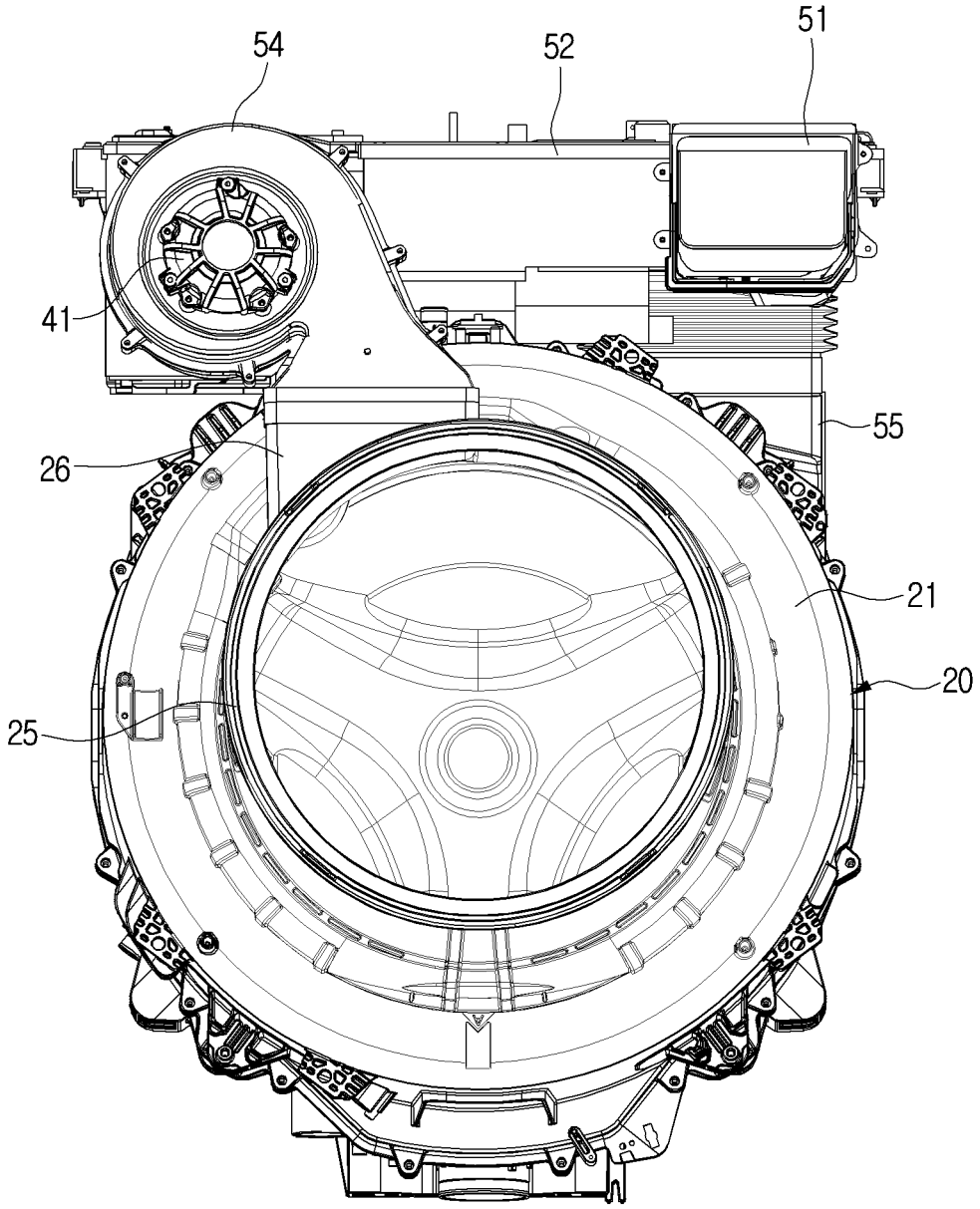
FIG. 4 is a front view illustrating a heated air supplying device of a washing machine with drying function according to an embodiment.
Figure 5:
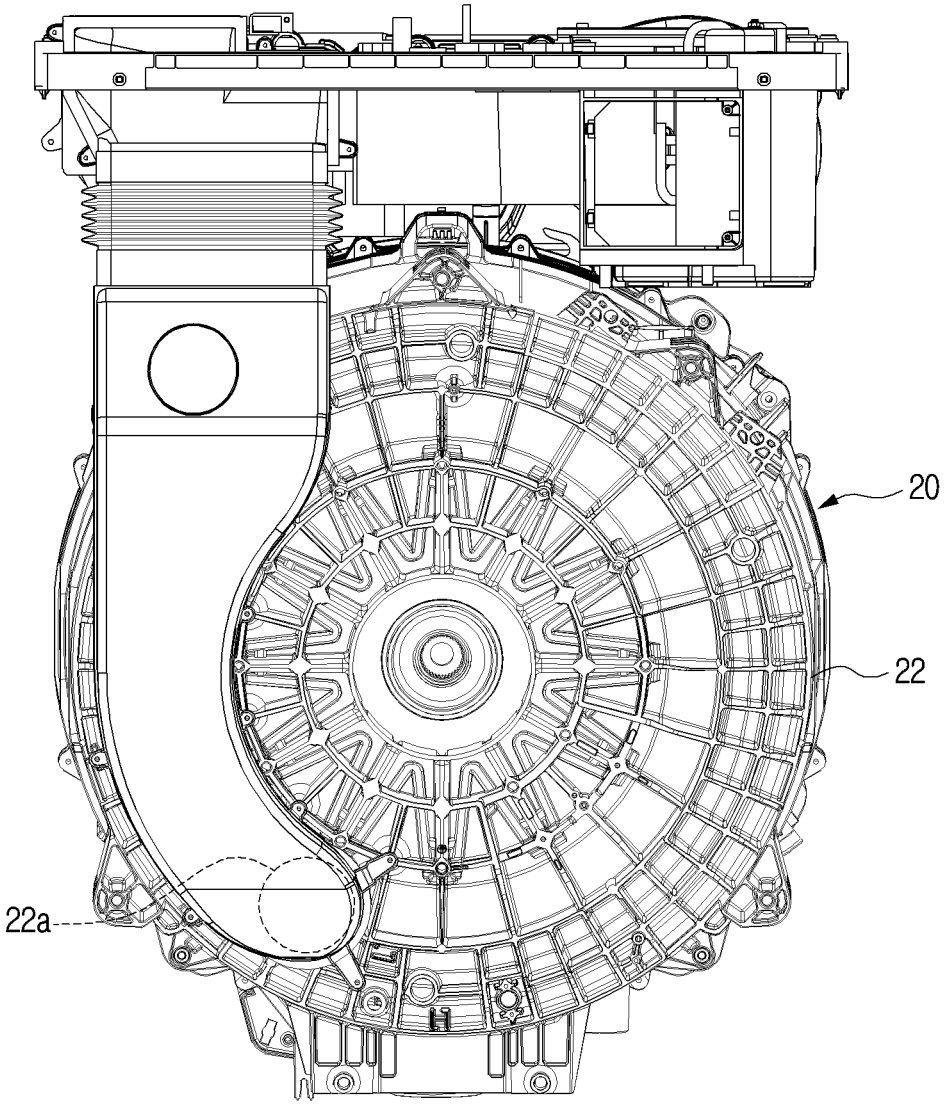
FIG. 5 is a back view illustrating a heated air supplying device of a washing machine with drying function according to an embodiment.

FIG. 2 is a perspective view illustrating a heated air supplying device of the washing machine with drying function according to an embodiment. FIG. 3 is a plane view illustrating the heated air supplying device of the washing machine with drying function according to an embodiment. FIG. 4 is a front view illustrating the heated air supplying device of the washing machine with drying function according to an embodiment. FIG. 5 is a back view illustrating the heated air supplying device of the washing machine with drying function according to an embodiment.

Referring to FIGS. 2 to 5, the washing machine with drying function 1 according to an embodiment may include the tub 20, the drum 30, and the heated air supplying device 40.

The heated air supplying device 40 may be installed above the tub 20, and may be formed so as to dry the laundry which is washed by the rotation of the drum 30. The heated air supplying device 40 may be formed to generate heated air by drying and heating air which is discharged from the tub 20 and to circulate the heated air through the inside of the tub 20 so as to dry the laundry which is located at the inside of the drum 30.

Referring to FIG. 2, the heated air supplying device 40 may include an upper duct 50 which is provided at the upper side of the tub 20, a back duct 55 which is provided at a back side of the tub 20, a blower fan 41 which generates a circulating airflow, and a heat exchange part 70 which removes moisture included in an airflow and heats the airflow.

The upper duct 50 may be formed to connect the back duct 55 and the blower fan 41 which is installed at the front side of the tub 20. The upper duct 50 may be formed roughly in an L-shape. At a back surface of the upper duct 50, an inlet port through which air that is discharged from the tub 20 is introduced may be provided, and at a front surface of the upper duct 50, an outlet port through which air is discharged may be provided. Here, the front surface and the back surface of the upper duct 50 may respectively mean surfaces corresponding to the front surface cover 11 and the back surface cover 12 of the cabinet 10.

The upper duct 50 may be formed such that the airflow which is introduced from the back side is bent in a right-angle direction, moved in a straight line for a certain distance, and then bent again in the right-angle direction to be discharged to the outside toward the front side of the cabinet 10. That is, the upper duct 50 may form an upper flow path which guides the airflow such that the airflow introduced from the back side is bent in a right-angle direction, moved in a straight line for a certain distance, and then bent again in the right-angle direction to be discharged to the outside toward the front side of the cabinet 10

The upper duct 50 may be installed adjacent to the front surface 21 of the tub 20. Accordingly, a space 44 in which the compressor 71 of the heat exchange part 70 is disposed may be provided between the back surface of the tub 20 and the upper duct 50 above the tub 20. Here, the front surface 21 of the tub 20 may refer to a surface at which the front opening 21*a* is formed. One side of the tub 20 may refer to a left side or a right side based on the front surface 21 of the tub 20, and the other side of the tub 20 may refer to the opposite side of the one side of the tub 20 based on the front surface 21 of the tub 20.

In the embodiment shown in FIGS. 2 and 3, the upper duct 50 may be installed to be adjacent to the front surface 21 of the tub 20. Accordingly, the space 44 in which the compressor 71 is to be installed may be provided between the upper duct 50 and the back surface of the tub 20 above the tub 20.

The inlet port 51*a* of the upper duct 50 may be provided to be adjacent to the one side and the back surface of the tub 20. The inlet port 51*a* of the upper duct 50 may be in communication with the outlet port 55*b* of the back duct 55.

Accordingly, the air that is discharged from the tub 20 may be introduced into the upper duct 50 in a direction from the back side of the tub 20 toward the front side of the tub 20.

An outlet port 53*b* of the upper duct 50 may be provided to be adjacent to the other side and the front surface 21 of the tub 20. Accordingly, the air that is discharged from the upper duct 50 may be discharged toward the front side of the tub 20.

The inlet port 51*a* and the outlet port 53*b* of the upper duct 50 may be provided in a diagonal direction above the tub 20. In other words, the inlet port 51*a* of the upper duct 50 may be provided at one side edge of the tub 20, and the outlet port 53*b* of the upper duct 50 may be provided at other side edge of the tub 20 which is positioned at an opposite side in the diagonal direction.

At the outlet port 53*b* of the upper duct 50, the blower fan 41 may be installed. The blower fan 41 may be contained inside a blow duct 54 which connects the upper duct 50 and the tub 20. An inlet 54*a* of the blow duct 54 may be formed so as to suction air that is being discharged from the outlet port 53*b* of the upper duct 50 toward the front side, and an outlet 54*b* of the blow duct 54 may be provided to discharge the airflow toward the diaphragm 25.

The upper duct 50 may include an inlet duct 51, a heat exchange duct 52, and a supply duct 53.

The inlet duct 51 may be provided to be adjacent to the one side of the tub 20 above the tub 20, and formed for the airflow which is discharged from the back opening 22*a* of the back surface plate 22 of the tub 20 to be introduced. The inlet duct 51 may be formed so that the introduced airflow flows in a straight line.

An inlet 51*a* of the inlet duct 51 may be connected with an outlet 55*b* of the back duct 55. The inlet 51*a* of the inlet duct 51 may form the inlet port 51*a* of the upper duct 50.

The inlet 51*a* of the inlet duct 51 may be provided at the back end of the inlet duct 51, and an outlet 51*b* of the inlet duct 51 may be provided at one side surface of the inlet duct 51, that is, the side surface that contacts the heat exchange duct 52. Accordingly, the outlet 51*b* of the inlet duct 51 may form a right-angle with the inlet 51*a* of the inlet duct 51.

A lint filter 42 may be installed at the inlet duct 51. The lint filter 42 may be installed to be separable from the inlet duct 51. The lint filter 42 may be installed to be attachable to or detachable from the inlet duct 51 from the front side of the tub 20.

The outlet 51*b* of the inlet duct 51 may be formed to be greater than the inlet 51*a*. For example, the outlet 51*b* of the inlet duct 51 may be formed to be greater by two times or more than the inlet 51*a* of the inlet duct 51. As described above, based on forming the outlet 51*b* of the inlet duct 51 to be greater than the inlet, the size of the lint filter 42 that is installed at the outlet 51*b* of the inlet duct 51 may be formed to be greater.

That is, the lint filter 42 may be formed to have a size corresponding to the inlet 52*a* of the heat exchange duct 52. When the size of the lint filter 42 is made greater, resistance in the duct by the lint filter 42 may be reduced.

The inlet duct 51 may have a rectangular cross-section, and the back end thereof may be connected to the back duct 55. That is, the inlet 51*a* may be provided at the back surface of the inlet duct 51. The inlet duct 51 may be installed to be adjacent to the one side of the tub 20 above the tub 20. A front surface of the inlet duct 51 may be adjacent to the front surface 21 of the tub 20, and the back surface thereof may be installed to be adjacent to the back surface of the tub 20.

The outlet 51*b* may be provided at the one side surface of the inlet duct 51. The outlet 51*b* of the inlet duct 51 may be formed to have a shape and size that corresponds to an inlet 52*a* of the heat exchange duct 52. The outlet 51*b* of the inlet duct 51 and the inlet 52*a* of the heat exchange duct 52 may be formed in a rectangular shape. The outlet 51*b* of the inlet duct 51 may be formed to be the same as or greater than the size of the inlet 52*a* of the heat exchange duct 52. A width of the outlet 51*b* of the inlet duct 51 may be smaller than a length of the inlet duct 51.

The airflow introduced into the inlet 51*a* of the inlet duct 51 may be introduced into the inlet 52*a* of the heat exchange duct 52 after passing the lint filter 42 which is installed at the outlet 51*b*.

The heat exchange duct 52 may be provided at a right-angle with respect to the inlet duct 51 above the tub 20, and connected at one side of the inlet duct 51. The heat exchange duct 52 may be formed so that the introduced airflow flows in a straight line.

A width of the heat exchange duct 52 may be maximized as much as possible to maximize a heat transfer area. However, the width of the heat exchange duct 52 may be smaller than the length of the inlet duct 51. For example, the width of the heat exchange duct 52 may be formed to be greater than or equal to half of a length of the tub 20. Accordingly, a part of the inlet duct 51 may protruded from a back surface of the heat exchange duct 52 toward the back surface cover 12 of the cabinet 10.

The inlet 52*a* of the heat exchange duct 52 may be provided at one end of the heat exchange duct 52, and an outlet 52*b* of the heat exchange duct 52 may be provided at the other end of the heat exchange duct 52. That is, the inlet 52*a* and the outlet 52*b* of the heat exchange duct 52 may be provided to face each other in a straight line. The inlet 52*a* and the outlet 52*b* of the heat exchange duct 52 may be formed to be the same as the cross-section of the heat exchange duct 52.

The inlet 52*a* of the heat exchange duct 52 may be connected with the outlet 51*b* of the inlet duct 51. The outlet 51*b* of the inlet duct 51 may be formed to have a shape and size that corresponds to the inlet 52*a* of the heat exchange duct 52.

The heat exchange duct 52 may have a rectangular cross-section, and both side ends thereof may be opened. The heat exchange duct 52 may be formed to have a widest possible cross-section area so as to fully maximize the heat transfer area.

The heat exchange duct 52 may be connected at a right-angle with the inlet duct 51. That is, the heat exchange duct 52 and the inlet duct 51 may be connected to each other so that a center line in a length direction of the heat exchange duct 52 and a center line in a length direction of the inlet duct 51 may be connected to form a right-angle.

The inlet 52*a* of the heat exchange duct 52 may be connected with the outlet 51*b* of the inlet duct 51. The outlet 51*b* of the inlet duct 51 may be formed to have a shape and size that corresponds to the inlet 52*a* of the heat exchange duct 52.

The heat exchange duct 52 may be installed above the tub 20 so that the front surface thereof is adjacent to the front surface 21 of the tub 20. The back surface of the heat exchange duct 52 may be spaced apart by a certain distance from the back surface of the tub 20.

At an inside of the heat exchange duct 52, an evaporator 73 and a condenser 72 of the heat exchange part 70 may be installed. Accordingly, the airflow that flows through the heat exchange duct 52 may sequentially pass the evaporator 73 and the condenser 72.

The supply duct 53 may be provided to be adjacent to the other side of the tub 20 above the tub 20, and formed to discharge the airflow introduced from the heat exchange duct 52 to the blower fan 41. The supply duct 53 may be connected with the heat exchange duct 52 at a right-angle. The supply duct 53 may be formed for the inlet airflow to flow in a straight line.

An inlet 53*a* of the supply duct 53 may be connected with the outlet 52*b* of the heat exchange duct 52. The inlet 53*a* of the supply duct 53 may be provided at one side surface of the supply duct 53, that is, a side surface which contacts the heat exchange duct 52. The inlet 53*a* of the supply duct 53 may be formed to have a shape and size that corresponds to the outlet 52*b* of the heat exchange duct 52.

An outlet 53*b* of the supply duct 53 may be formed at a front surface of the supply duct 53, and provided at a right-angle with the inlet 53*a* of the supply duct 53. The outlet 53*b* of the supply duct 53 may be connected with a suction hole of the blower fan 41, that is, the inlet 54*a* of the blow duct 54. The outlet 53*b* of the supply duct 53 may form the outlet port 53*b* of the upper duct 50.

The outlet 53*b* of the supply duct 53 may be formed to discharge air toward the front side of the tub 20. Accordingly, the air may be discharged from the outlet 53*b* of the supply duct 53 in a direction that is roughly perpendicular to the front surface of the cabinet 10.

For example, the outlet 53*b* of the supply duct 53 and the suction hole of the blower fan 41 which is installed at the front side of the tub 20, that is, the inlet 54*a* of the blow duct 54, may be formed for the airflow that is discharged from the outlet 53*b* of the supply duct 53 to be suctioned into the blower fan 41 in a straight line.

The supply duct 53 may have a rectangular cross-section, and a front end thereof may be connected with the blower fan 41. That is, the outlet 53*b* may be provided at the front end of the supply duct 53. The outlet 53*b* of the supply duct 53 may be formed to have a shape and size that corresponds with the suction hole of the blower fan 41.

The supply duct 53 may be installed to be adjacent to the other side of the tub 20 above the tub 20. The front surface of the supply duct 53 may be adjacent to the front surface 21 of the tub 20, and the back surface thereof may be installed to be spaced apart at a certain distance from the back surface of the tub 20.

The supply duct 53 may be connected at a right-angle with the heat exchange duct 52. That is, the supply duct 53 and the heat exchange duct 52 may be connected to each other so that the center line in the length direction of the heat exchange duct 52 and a center line in a length direction of the supply duct 53 form a right-angle.

The inlet 53*a* may be provided at the one side surface of the supply duct 53. The inlet 53*a* of the supply duct 53 may be formed to have a shape and size that corresponds to the outlet 52*b* of the heat exchange duct 52. For example, the inlet 53*a* of the supply duct 53 and the outlet 52*b* of the heat exchange duct 52 may be formed in a rectangular shape. The supply duct 53 may be formed to have a length that is roughly the same as the width of the heat exchange duct 52.

The back surface and other side surface of the supply duct 53 may be connected by an inclined surface 53*d*1. Based on the above, the airflow introduced into the inlet 53*a* of the supply duct 53 may collide with the inclined surface 53*d*1 and be discharged through the outlet 53*b* of the supply duct 53. When the inclined surface 53*d*1 is installed at the supply duct 53 as described above, the airflow introduced into the supply duct 53 may be effectively guided to the outlet 53*b*. In another example, the inclined surface 53*d*1 of the supply duct 53 may be formed as a curved surface which can guide the airflow introduced into the inlet 53*a* to the outlet 53*b*.

At an inside of the supply duct 53, a heater 80 may be installed.

The front surface of the inlet duct 51, a front surface of the heat exchange duct 52, and the front surface of the supply duct 53 may be positioned on roughly a same plane. In addition, between the one side surface of the inlet duct 51, the back surface of the heat exchange duct 52, the back surface of the supply duct 53, and the back surface of the tub 20, the space 44 may be formed. In the space 44, the compressor 71, an expansion valve 74, and a refrigerant pipe 75 of the heat exchange part 70 may be installed.

The back duct 55 may be provided at the back surface plate 22 of the tub 20, and formed to guide the airflow that is discharged from the tub 20 toward the upper side of the tub 20. At the back surface plate 22 of the tub 20, the back opening 22*a* through which the airflow is discharged may be provided. An inlet of the back duct 55 may be connected with the back opening 22*a* of the tub 20.

The outlet 55*b* of the back duct 55 may be provided to be biased to one side on the back surface of the tub 20, and connected with the inlet 51*a* of the inlet duct 51. The outlet 55*b* of the back duct 55 may be formed to have a shape and size corresponding to the inlet 51*a* of the inlet duct 51. Accordingly, the air that is discharged from the back opening 22*a* of the tub 20 may be introduced into the inlet duct 51 through the back duct 55.

The back duct 55 may be installed to be biased toward one side on the back surface plate 22 of the tub 20.

The blower fan 41 may be formed to form a flow of air, that is, an airflow so that the air that is discharged from the supply duct 53 may be supplied to the front opening 21*a* of the tub 20.

The blower fan 41 may be installed at the front surface 21 of the tub 20. The blower fan 41 may be formed for the airflow to be introduced into the back surface thereof and discharged through a lower surface thereof. That is, the blower fan 41 may be formed for a discharge direction of the airflow to roughly form 90 degrees with an inlet direction of the airflow. Accordingly, when the blower fan 41 is operated, the air which is discharged from an outlet of the supply duct 53 toward the front side of the tub 20 may be introduced into the blower fan 41, and the air may be discharged downwards from the blower fan 41 toward the diaphragm 25.

The blower fan 41 may be contained at an inside of the blow duct 54. The blow duct 54 may be installed at the front surface 21 of the tub 20, and connect the supply duct 53 and the diaphragm 25. Accordingly, the air that is discharged from the supply duct 53 may be supplied to an inside of the diaphragm 25 through the blow duct 54.

The blow duct 54 may be formed for the airflow that is discharged from the blower fan 41 to be supplied to the diaphragm 25 positioned below. The blow duct 54 may be formed for the airflow that is formed by the blower fan 41 to be supplied in a straight line to the inside of the diaphragm 25.

The inlet 54*a* of the blow duct 54 may be provided at the back surface thereof, and form the suction hole of the blower fan 41. The inlet 54*a* of the blow duct 54 may be connected with the outlet 53*b* of the supply duct 53. The inlet 54*a* of the blow duct 54 and the outlet 53*b* of the supply duct 53 may be positioned in a straight line. That is, the inlet 54*a* of the blow duct 54 may be directly connected to the outlet 53*b* of the supply duct 53.

The outlet 54*b* of the blow duct 54 may be provided at a lower surface of the blow duct 54, and connected with an inlet port 25*a* of the diaphragm 25. The outlet 54*b* of the blow duct 54 and the inlet port 25*a* of the diaphragm 25 may be positioned in a straight line. That is, the outlet 54*b* of the blow duct 54 may be directly connected with the inlet port 25*a* of the diaphragm 25.

At an upper part of the diaphragm 25, a connecting part 26 to which the blow duct 54 is connected may be provided. The connecting part 26 may be formed to have a shape and size that corresponds to the lower surface of the blow duct 54, and the inlet port 25*a* corresponding to the outlet 54*b* of the blow duct 54 may be provided inside the connecting part 26.

Accordingly, the airflow that is discharged by the blower fan 41 may be introduced into the inside of the diaphragm 25, that is, the inside of the drum 30, in a straight line through the blow duct 54 and the connecting part 26.

As the blower fan 41, a sirocco fan may be used.

When the blower fan 41 rotates, the air may be suctioned into the inlet 54*a* of the blow duct 54 and then discharged through the outlet 54*b* provided on the lower surface of the blow duct 54. Accordingly, the direction of the airflow discharged from the outlet 54*b* of the blow duct 54 may roughly form 90 degrees with the direction of the airflow which is suctioned into the inlet 54*a* of the blow duct 54.

The heat exchange part 70 may be formed to remove moisture from the air that passes the heat exchange duct 52 and heat the air, thereby generating dried air in high temperature. The heat exchange part 70 may be formed as a heat pump. If necessary, the dried air in high temperature may be referred to as the heated air.

The heat exchange part 70 may include the compressor 71, the evaporator 73, the condenser 72, and the expansion valve 74. In addition, the heat exchange part 70 may include the refrigerant pipe 75 through which the refrigerant circulates by connecting the compressor 71, the evaporator 73, the condenser 72, and the expansion valve 74.

The heat exchange part 70 may be formed to remove the moisture contained in the air and heat the air through heat exchange between the refrigerant and the air while the refrigerant circulates through the condenser 72, the expansion valve 74, and the evaporator 73 by the compressor 71.

The evaporator 73 and the condenser 72 may be installed at the heat exchange duct 52. The evaporator 73 and the condenser 72 may be installed at an inside of the heat exchange duct 52 to be spaced apart at a certain distance, and the condenser 72 may be installed at a downstream of the evaporator 73 in a circulating direction of the airflow.

The evaporator 73 may be installed to be adjacent to the inlet duct 51, and may remove the moisture by cooling humid air that is discharged from the tub 20.

The condenser 72 may be installed to be adjacent to the supply duct 53, and may heat the air that passed the evaporator 73. Accordingly, the dried air in high temperature may be discharged into the diaphragm 25 by the blower fan 41.

The compressor 71 may be installed at an outer side of the upper duct 50, that is, the supply duct 53 above the tub 20. That is, the compressor 71 may be installed in the space 44 between the supply duct 53 and the back surface of the tub 20. A refrigerant pipe 45 may be installed in the space 44 that is formed by the inlet duct 51, the heat exchange duct 52, the supply duct 53, and the back surface of the tub 20 above the tub 20.

The inlet duct 51, the heat exchange duct 52, the supply duct 53, the back duct 55, and the blow duct 54 may respectively form an inlet flow path, a heat exchange flow path, a supply flow path, a back flow path, and a blow flow path.

For example, an inner space of the inlet duct 51 may form the inlet flow path, an inner space of the heat exchange duct 52 may form the heat exchange flow path, and an inner space of the supply duct 53 may form the supply flow path. In addition, an inner space of the back duct 55 may form the back flow path, and an inner space of the blow duct 54 may form a blow flow path.

The inlet flow path, the heat exchange flow path, and the supply flow path may form an upper flow path which is provided at the upper side of the tub 20. Accordingly, the tub 20, the back flow path which is provided at the back surface of the tub 20, the upper flow path which is provided at the upper side of the tub 20, and the blow flow path which is provided at the front surface of the tub 20 may form a circulating flow path.

Accordingly, when the blower fan 41 which is disposed in the blow flow path is operated, the air inside the drum 30 may circulate along the circulating flow path.

The upper duct 50 of the washing machine with drying function 1 according to an embodiment will be described in detail below with reference to FIGS. 6 to 11.

Figure 6:
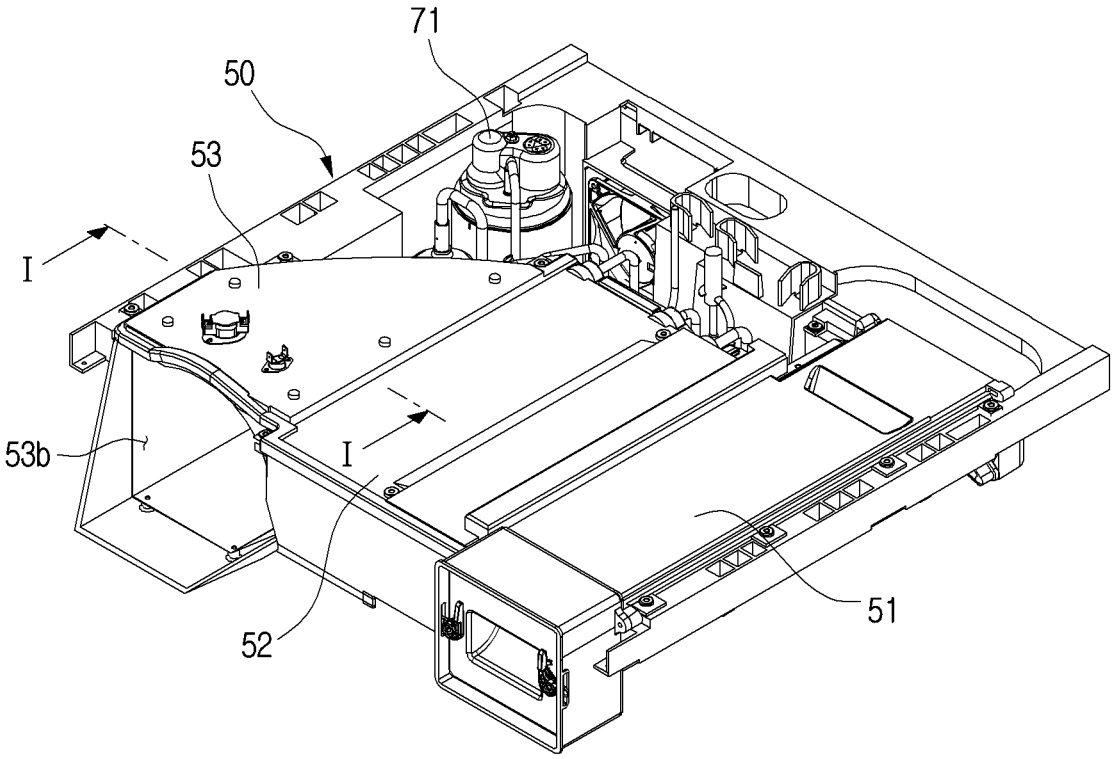
FIG. 6 is a perspective view illustrating an upper duct of a washing machine with drying function according to an embodiment.
Figure 7:
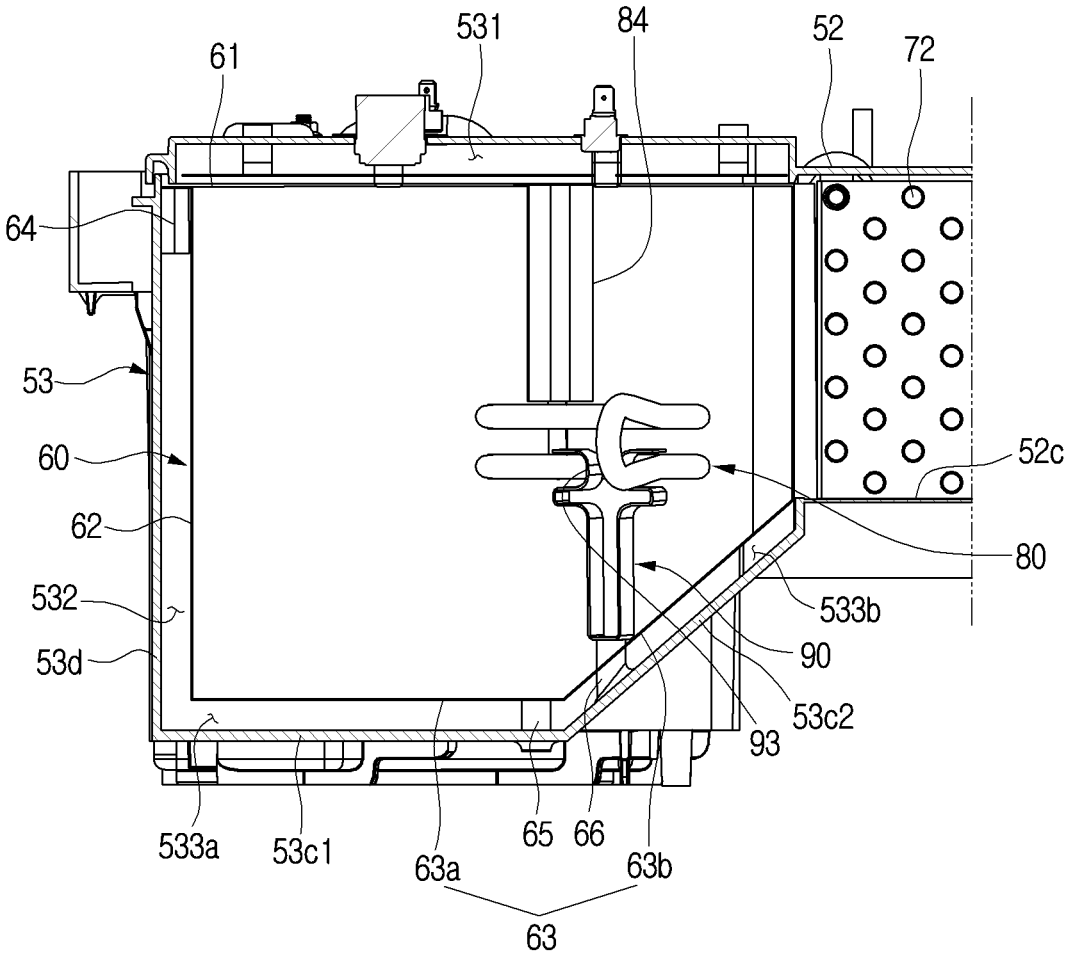
FIG. 7 is a partial cross-sectional view of the upper duct of FIG. 6 taken along line I-I.
Figure 8:
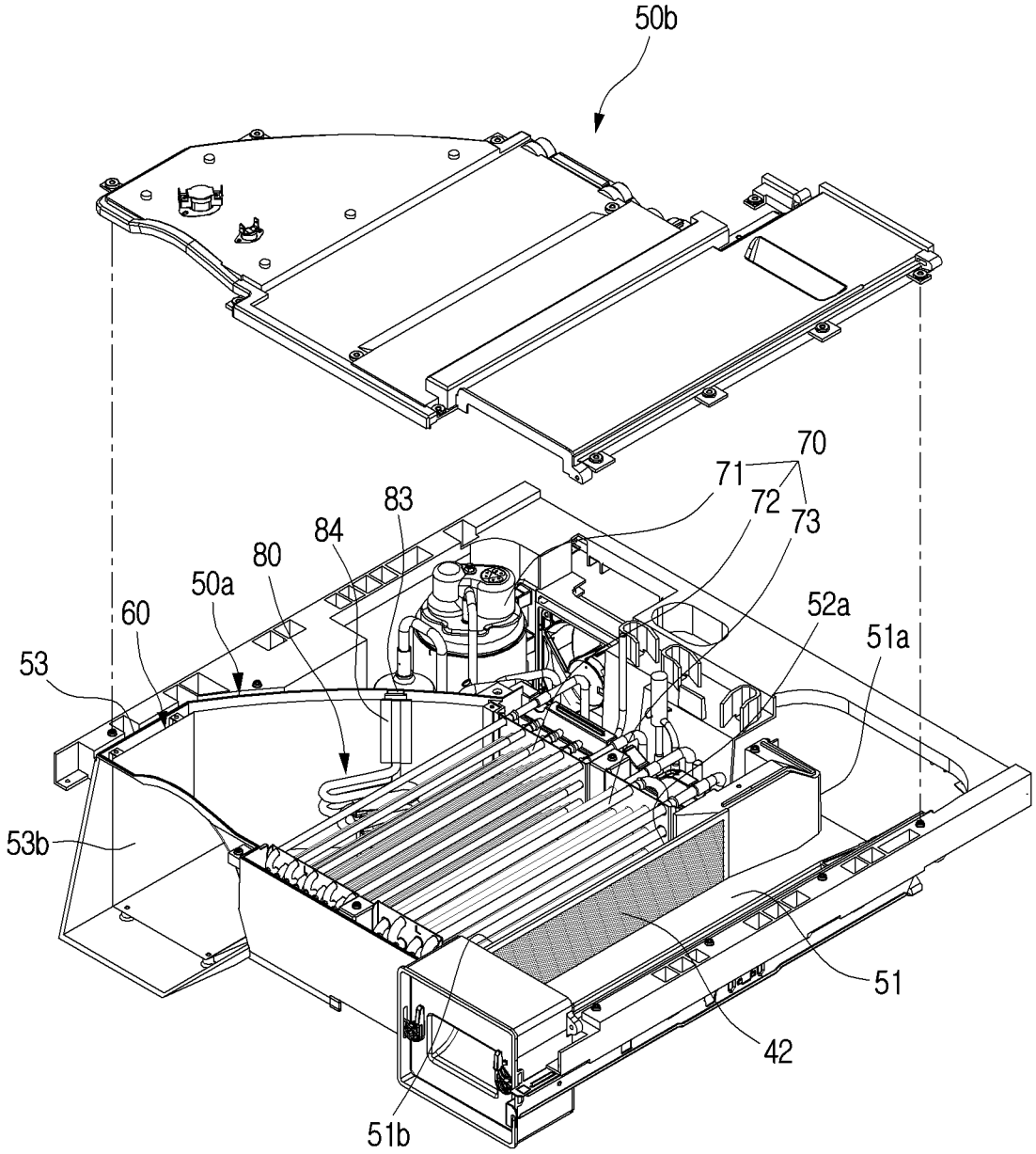
FIG. 8 is a perspective view illustrating a state in which a duct cover is separated from the upper duct of FIG. 6.
Figure 9:
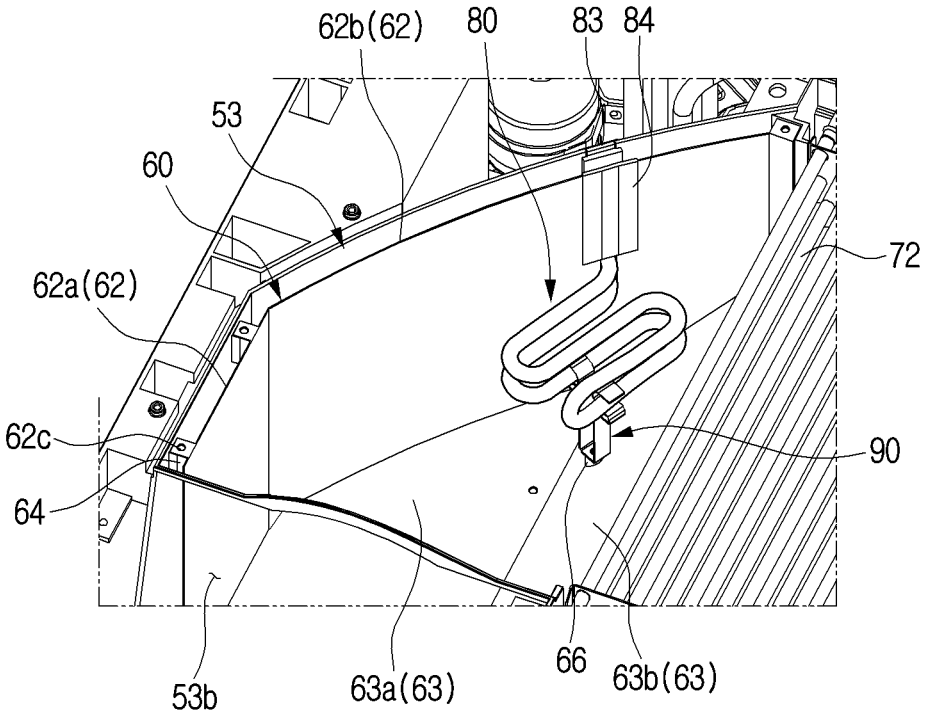
FIG. 9 is a partial perspective view illustrating a supply duct in FIG. 8.
Figure 10:
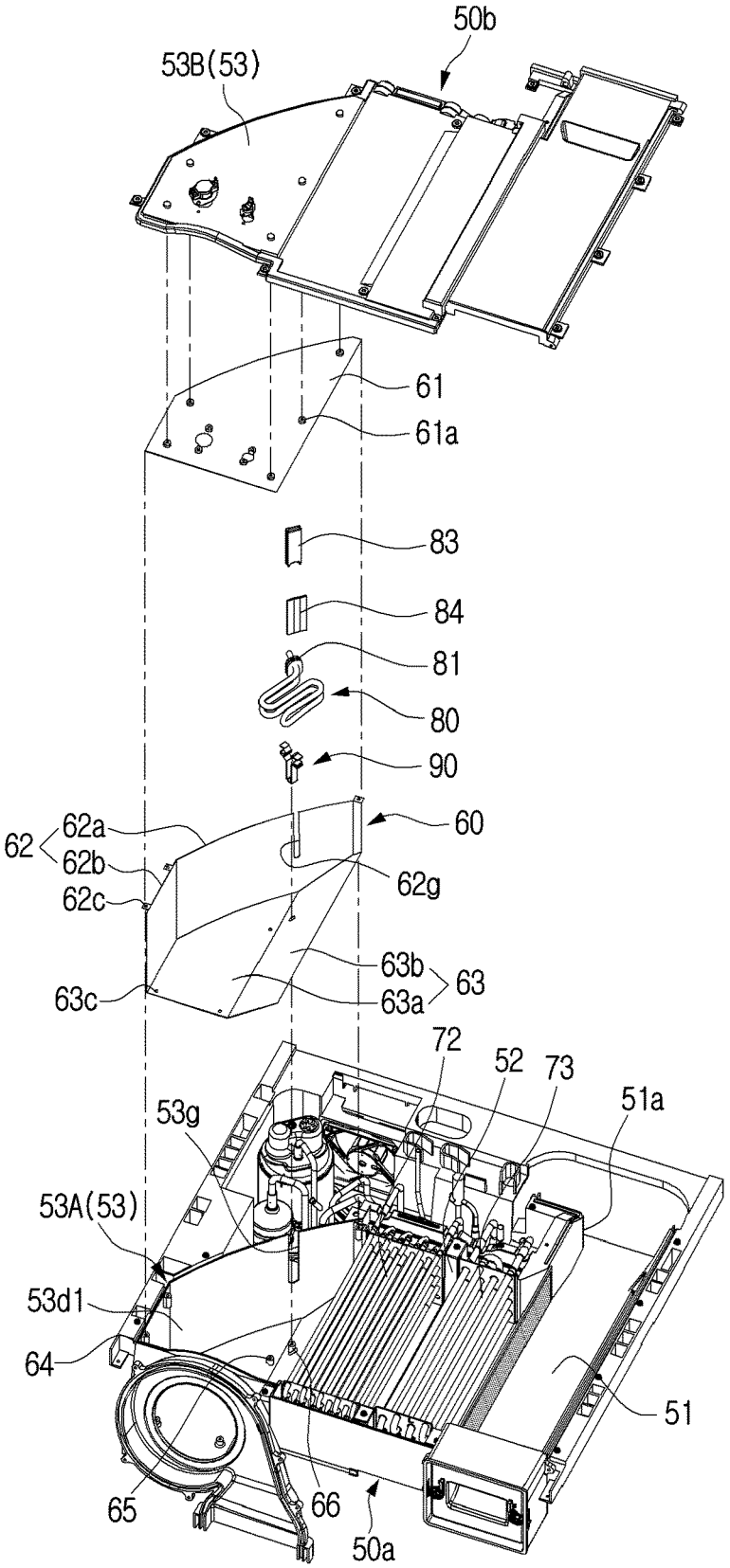
FIG. 10 is an exploded perspective view illustrating the upper duct of FIG. 6.
Figure 11:
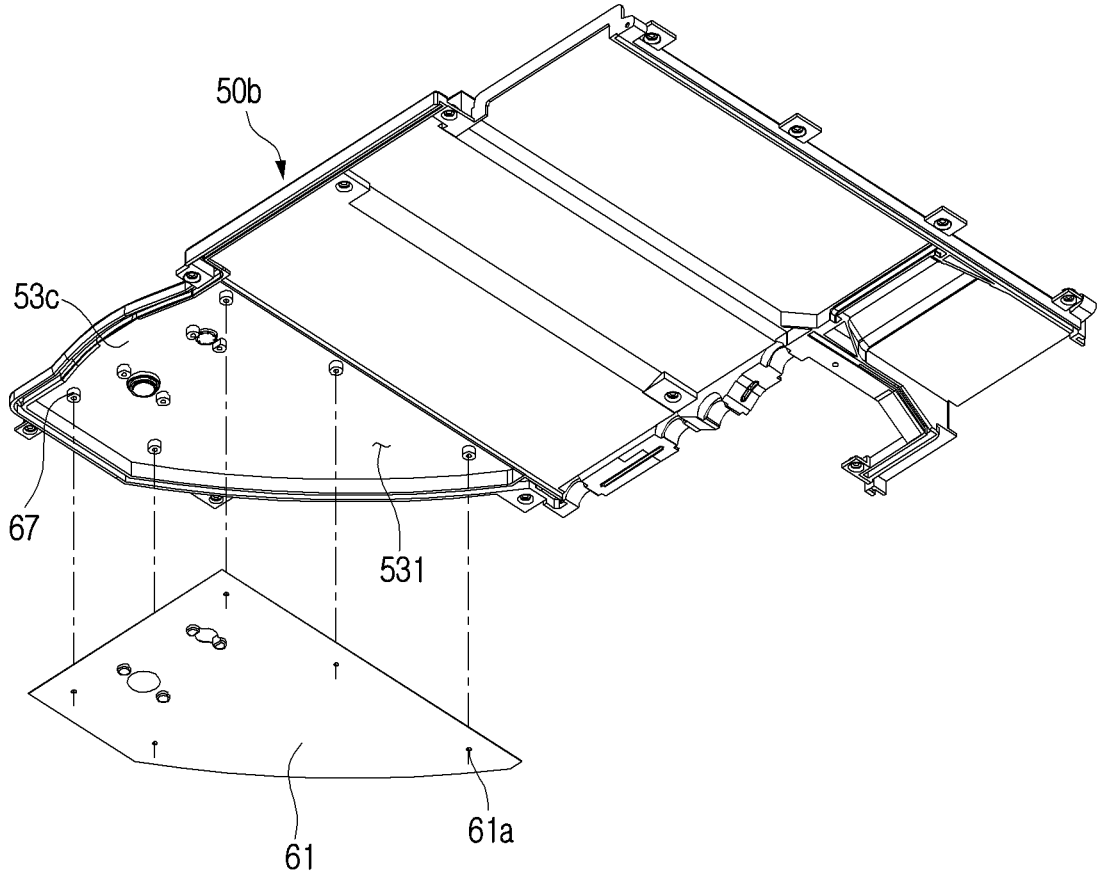
FIG. 11 is a bottom perspective view illustrating a duct cover of a washing machine with drying function according to an embodiment.

FIG. 6 is a perspective view illustrating an upper duct of the washing machine with drying function according to an embodiment. FIG. 7 is a partial cross-sectional view of the upper duct of FIG. 6 taken along line I-I. FIG. 8 is a perspective view illustrating a state in which a duct cover is separated from the upper duct of FIG. 6. FIG. 9 is a partial perspective view illustrating a supply duct in FIG. 8. FIG. 10 is an exploded perspective view illustrating the upper duct of FIG. 6. FIG. 11 is a bottom perspective view illustrating the duct cover of the washing machine with drying function according to an embodiment.

Referring to FIGS. 6 to 10, the upper duct 50 of the washing machine with drying function 1 according to an embodiment may include the inlet duct 51, the heat exchange duct 52, and the supply duct 53.

The inlet duct 51 may have a rectangular cross-section, and the back end thereof may be connected to the back duct 55. That is, the inlet 51*a* may be provided at the back surface of the inlet duct 51. The inlet duct 51 may be installed to be adjacent to the one side of the tub 20 above the tub 20. The front surface of the inlet duct 51 may be adjacent to the front surface 21 of the tub 20, and the back surface thereof may be installed to be adjacent to the back surface of the tub 20.

The outlet 51*b* may be provided at the one side surface of the inlet duct 51. The outlet 51*b* of the inlet duct 51 may be greater than the inlet 51*a* thereof. The outlet 51*b* of the inlet duct 51 may be formed to have a shape and size that corresponds to the inlet 52*a* of the heat exchange duct 52.

The outlet 51*b* of the inlet duct 51 and the inlet 52*a* of the heat exchange duct 52 may be formed in a rectangular shape. The width of the outlet 51*b* of the inlet duct 51 may be smaller than the length of the inlet duct 51.

The inlet 51*a* and the outlet 51*b* of the inlet duct 51 may be disposed at a right-angle.

The heat exchange duct 52 may have a rectangular cross-section, and both side ends thereof may be opened. The heat exchange duct 52 may be formed to have a widest possible cross-section area so as to fully maximize the heat transfer area.

The inlet 52*a* and the outlet 52*b* of the heat exchange duct 52 may be formed to have a cross-section that is the same as the cross-section of the heat exchange duct 52. The heat exchange duct 52 may be disposed at a right-angle with the inlet duct 51.

The outlet 52*b* of the heat exchange duct 52 may be provided to face the inlet 52*a* of the heat exchange duct 52. That is, the outlet 52*b* and the inlet 52*a* of the heat exchange duct 52 may be disposed in a straight line.

The evaporator 73 and the condenser 72 of the heat exchange part 70 may be installed at the inside of the heat exchange duct 52. Accordingly, the airflow that flows through the heat exchange duct 52 may sequentially pass the evaporator 73 and the condenser 72.

The supply duct 53 may have a rectangular cross-section, and the outlet 53*b* thereof may be provided at the front end of the supply duct 53. The outlet 53*b* of the supply duct 53 may be formed to have a shape and size that corresponds with the inlet 54*a* of the blow duct 54.

The supply duct 53 may be disposed at a right-angle with respect to the heat exchange duct 52.

The supply duct 53 may be disposed at an opposite side with the inlet duct 51 based on the heat exchange duct 52. That is, the inlet duct 51 may be disposed at the one end of the heat exchange duct 52, and the supply duct 53 may be disposed at the other end of the heat exchange duct 52.

The inlet 53*a* may be provided at the one side surface of the supply duct 53. The inlet 53*a* of the supply duct 53 may be formed to have a shape and size that corresponds to the outlet 52*b* of the heat exchange duct 52. For example, the inlet 53*a* of the supply duct 53 and the outlet 52*b* of the heat exchange duct 52 may be formed in a rectangular shape. The supply duct 53 may be formed to have a length that is roughly the same as the width of the heat exchange duct 52.

The inlet 53*a* and the outlet 53*b* of the supply duct 53 may be disposed at a right-angle.

The supply duct 53 may include an inclined surface. For example, the supply duct 53 may include the inclined surface 53*d*1 that connects the back surface and the other side surface of the supply duct 53. The airflow introduced into the inlet 53*a* of the supply duct 53 may be discharged through the outlet 53*b* of the supply duct 53 by colliding with the inclined surface 53*d*1. In another example, the inclined surface 53*d*1 may form a curved surface which can convert a moving direction of the airflow introduced into the inlet 53*a* by roughly 90 degrees and guide to the outlet 53*b*.

The supply duct 53 may be formed to have a size corresponding to the suction hole of the blower fan 41. For example, a height of the supply duct 53 may be greater than a height of the heat exchange duct 52. At this time, because the supply duct 53 is positioned to be adjacent to the other side of the tub 20, it may be formed to be higher than the height of the heat exchange duct 52 which is positioned at a center of a width direction of the tub 20. That is, because the supply duct 53 is biased to one side from the center of the width direction of the tub 20 having a cylindrical shape, the height of the supply duct 53 may be made higher than the heat exchange duct 52 which is positioned at the center of the width direction.

An upper surface of the supply duct 53 may be formed with roughly a same plane as with an upper surface of the heat exchange duct 52. A lower surface of the supply duct 53 may be formed to be positioned lower than a lower surface 52*c* of the heat exchange duct 52. The lower surface of the supply duct 53 may include a horizontal surface 53*c*1 and a lower inclined surface 53*c*2. The lower inclined surface 53*c*2 may be formed to connect the horizontal surface 53*c*1 of the supply duct 53 and the lower surface 52*c* of the heat exchange duct 52.

The side surface 53*d* of the supply duct 53 may be formed to connect the upper surface and a lower surface 53*c*1. The inclined surface 53*d*1 which is extended from the side surface 53*d* of the supply duct 53 may be formed to connect the upper surface and the lower surface, that is, the horizontal surface 53*c*1 and the lower inclined surface 53*c*2.

The front surface of the inlet duct 51, the front surface of the heat exchange duct 52, and the front surface of the supply duct 53 may be positioned on roughly the same plane. That is, the front surface of the inlet duct 51, the front surface of the heat exchange duct 52, and the front surface of the supply duct 53 may form the front surface of the upper duct 50.

The inlet duct 51, the heat exchange duct 52, and the supply duct 53 may be formed as one body. That is, the inlet duct 51, the heat exchange duct 52, and the supply duct 53 may form the upper duct 50 by being formed as one body.

As shown in FIGS. 8 and 10, the upper duct 50 may include a duct body 50*a* and a duct cover 50*b*. The duct body 50*a* may be formed in a U-shape with a flat bottom and an upper surface thereof may be opened. The duct cover 50*b* may be formed to cover the upper surface of the duct body 50*a*. That is, the duct cover 50*b* is coupled to the upper surface of the duct body 50*a*, thereby forming the upper duct 50.

When the duct cover 50*b* is opened, the evaporator 73, the condenser 72, and the heater 80 may be installed at an inside of the duct body 50*a*.

At the inside of the supply duct 53, the heater 80 may be installed. That is, the heater 80 may be disposed at a downstream of the condenser 72 based on the circulating direction of air.

The heater 80 may be formed to heat the air that passes through the supply duct 53.

For the heater 80, a heater that is small in size with strong heating capabilities may be used. That is, for the heater 80, a heater with strong heating capabilities per unit area may be used. For example, a sheath heater may be used as the heater 80.

The heater 80 may be formed to minimize the flow resistance. For example, the heater 80 may be formed in a shape in which a cross-section area is minimized in the air flowing direction. To this end, a sheath heater 80 of a circular pipe shape may be bent several times to form the heater 80.

Figure 12:
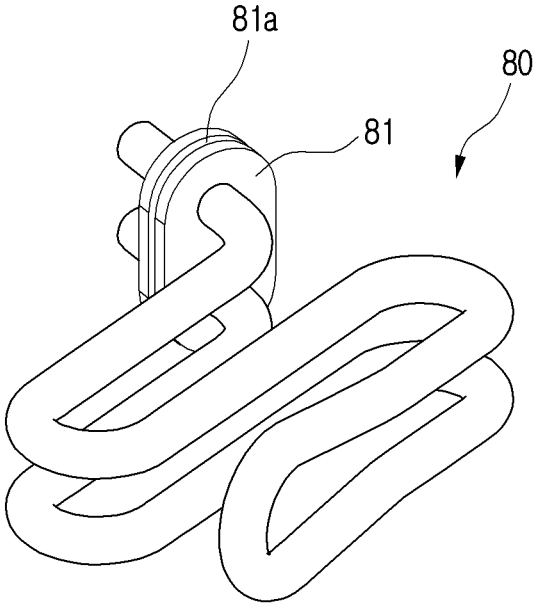
FIG. 12 is a perspective view illustrating a heater of a washing machine with drying function according to an embodiment.

FIG. 12 is a perspective view illustrating a heater of the washing machine with drying function according to an embodiment.

Referring to FIG. 12, the heater 80 may be formed by forming a U-shape with a narrow width by folding the sheath heater of a certain length in half, and bending the sheath heater which is bent in the U-shape twice to the U-shape with the narrow width to the upper side.

At one end of the heater 80, a fixing bracket 81 for fixing the heater 80 may be installed. The fixing bracket 81 may be formed so as to be inserted into a fixing groove 53*g* of the supply duct 53.

The heater 80 may be fixed to one side surface of the supply duct 53. The heater 80 maybe protruded to the inside of the supply duct 53, and wiring which is connected to the heater 80 may be disposed at the outer side of the supply duct 53.

At one side surface of the supply duct 53, the fixing groove 53*g* may be provided. A depth of the fixing groove 53*g* may be formed up to a height which is roughly half of the height of the supply duct 53 from the upper end of the supply duct 53.

When the fixing bracket 81 of the heater 80 is inserted in the fixing groove 53*g* of the supply duct 53, the heater 80 may be fixed to the supply duct 53.

At both side surfaces of the fixing bracket 81, a pair of guiding grooves 81*a* into which both side walls of the supply duct 53 forming the fixing groove 53*g* can be inserted may be provided. Accordingly, when the pair of guiding grooves 81*a* of the fixing bracket 81 is inserted into both side walls of the supply duct 53 that form the fixing groove 53*g*, the fixing bracket 81 of the heater 80 may be fixed to the side surface of the supply duct 53.

At the fixing groove 53*g* of the supply duct 53, a blocking piece 83 that blocks the fixing groove 53*g* may be installed. Accordingly, when the fixing bracket 81 of the heater 80 is inserted into the fixing groove 53*g* and then the blocking piece 83 is inserted into the fixing groove 53*g*, the heater 80 may be fixed to the supply duct 53.

At both side surfaces of the blocking piece 83, a pair of guiding grooves into which both side walls of the fixing groove 53*g* can be inserted may be provided. Accordingly, when the pair of guiding grooves of the blocking piece 83 is inserted into both side walls of the supply duct 53 that form the fixing groove 53*g*, the blocking piece 83 may be fixed to the side surface of the supply duct 53.

In the embodiment, the heater 80 may be fixed to the inclined surface 53*d*1 of the supply duct 53. The fixing bracket 81 of the heater 80 may be inserted into the fixing groove 53*g* which is formed at the inclined surface 53*d*1 of the supply duct 53.

The heater 80 may be supported by a heater bracket 90 that is installed at the supply duct 53. When the heater 80 is supported by the heater bracket 90, the heater 80 may be prevented from contacting an inner surface of the supply duct 53. The heater bracket 90 may be installed at the lower surface 53*c*1 or at the lower inclined surface 53*c*2 of the supply duct 53.

Referring to FIGS. 7 and 9, the heater bracket 90 may be installed at the lower inclined surface 53*c*2 of the supply duct 53 according to an embodiment.

The heater bracket 90 may be fixed to the lower inclined surface 53*c*2 of the supply duct 53 and formed so as to support the heater 80. The heater bracket 90 may be formed to support a leading end portion of the heater 80.

Figure 13:
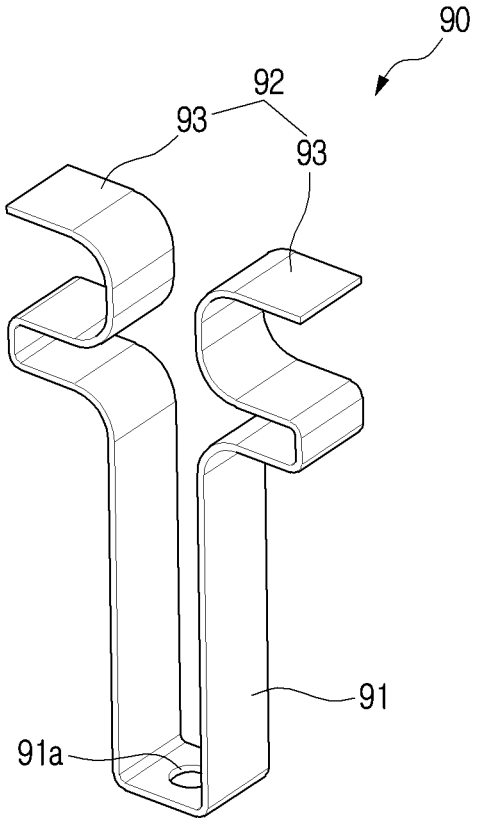
FIG. 13 is a perspective view illustrating a heater bracket of a washing machine with drying function according to an embodiment.

FIG. 13 is a perspective view illustrating a heater bracket of the washing machine with drying function according to an embodiment.

Referring to FIG. 13, the heater bracket 90 may include a fixing part 91 and a supporting part 92.

The fixing part 91 may be formed in a U-shape with a flat bottom. At the bottom of the fixing part 91, a fixing hole 91*a* through which a bolt or a screw can be inserted may be provided.

The supporting part 92 may be extended from both arms of the fixing part 91, and formed to support the heater 80.

For example, the supporting part 92 may be formed to be coupled to two circular pipe parts of the heater 80 which are disposed parallel as shown in FIGS. 7 and 9. At this time, the two circular pipe parts may be disposed to be in a horizontal state.

The supporting part 92 may be formed in a U-shape for the circular pipe part to be inserted. That is, the supporting part 92 may include two U-shaped parts 93 into which two circular pipe parts are inserted. Inlets of the two U-shaped parts 93 may be formed toward the outer side. The two U-shaped parts 93 may be formed in line symmetry.

Accordingly, when the two U-shaped parts 93 are positioned between the two circular pipe parts of the heater 80, the two U-shaped parts 93 may push the two circular pipe parts toward the outside. Accordingly, the two U-shaped parts 93 may not be easily separated from the two circular pipe parts of the heater 80.

The heater bracket 90 having a structure as described above may be formed by bending a thin steel plate having a strip shape. Then, the heater bracket 90 may support the heater 80 as the two U-shaped parts 93 are in close contact with the two circular pipe parts of the heater 80 by elasticity.

At the lower inclined surface 53*c*2 of the supply duct 53, a fixing boss 66 may be provided. A female screw may be formed at the fixing boss 66. Accordingly, when a bolt or a screw is inserted into the fixing hole 91*a* of the heater bracket 90 and fastened to the female screw of the fixing boss 66 of the supply duct 53, the heater bracket 90 may be fixed to the supply duct 53.

In the above, a shape of the heater bracket 90 has been described with reference to FIG. 13, but the shape of the heater bracket 90 is not limited thereto. As long as the heater bracket 90 can support the heater 80 installed at the one side surface of the supply duct 53, the heater bracket 90 may be formed in various shapes.

At the inside of the supply duct 53, a barrier 60 may be provided. Because the supply duct 53 is formed of an injection-molded product of plastic or resin, it may be deformed or ignited by heat from the heater 80. The barrier 60 may be formed to prevent the supply duct 53 from being deformed or ignited by the heat of the heater 80.

The barrier 60 may be installed at the inner surface of the supply duct 53. The barrier 60 may be disposed parallel with the inner surface of the of the supply duct 53. The barrier 60 may be installed to be spaced apart by a certain distance from the inner surface of the supply duct 53.

The barrier 60 may be formed as a flat plate. The barrier 60 may be formed of a metal material so as to prevent ignition. For example, the barrier 60 may be formed with a steel plate, an aluminum plate, and an aluminum foil.

The barrier 60 may be formed to cover the inner surface of the supply duct 53, that is, the upper surface, the lower surface, and the side surface. The barrier 60 may be disposed to be parallel with the upper surface, the lower surface, and the side surface of the supply duct 53.

For example, the barrier 60 may include an upper barrier 61 which is formed to cover the upper surface of the supply duct 53, a side barrier 62 which is formed to cover the side surface of the supply duct 53, and a lower barrier 63 which is formed to cover the lower surface of the supply duct 53.

The upper barrier 61 may be formed in a flat plate having a shape and size that corresponds to the upper surface of the supply duct 53.

The side barrier 62 may be formed in a flat plate having a shape and size that corresponds to the side surface of the supply duct 53. The side barrier 62 may be bent to correspond to the inclined surface 53*d*1 of the supply duct 53. The side barrier 62 may be provided with a barrier fixing groove 62*g* corresponding to the fixing groove 53*g* of the supply duct 53.

The barrier fixing groove 62*g* may be formed to have a depth that corresponds to the fixing groove 53*g* of the supply duct 53. Into the barrier fixing groove 62*g*, the heater 80 may be inserted.

At the barrier fixing groove 62*g*, a barrier blocking piece 84 may be installed. The barrier blocking piece 84 may be formed to block an upper part of the barrier fixing groove 62*g* when the heater 80 is inserted into the barrier fixing groove 62*g*. The barrier blocking piece 84 may be formed by folding a thin metal sheet having a width wider than the barrier fixing groove 62*g* in half. When the bent barrier blocking piece 84 is inserted into the side barrier 62 to cover the barrier fixing groove 62*g*, the barrier fixing groove 62*g* may be blocked.

The lower barrier 63 may be formed as a flat plate having a shape and size that corresponds to the lower surface of the supply duct 53. The lower barrier 63 may include a horizontal barrier 63*a* and a lower inclined barrier 63*b* that correspond to the horizontal surface 53*c*1 and the lower inclined surface 53*c*2 of the lower surface of the supply duct 53.

The side barrier 62 and the lower barrier 63 may be formed as one body. The upper barrier 61 may be formed separately from the side barrier 62 and the lower barrier 63. The upper barrier 61 may be installed so as to be coupled to upper ends of the side barrier 62 and the lower barrier 63.

At the inner surface of the supply duct 53, a barrier groove in which the barrier 60 is installed may be provided. The barrier groove may be formed such that an upper surface of the barrier 60 matches with an inner surface of the heat exchange duct 52. That is, the barrier groove may be formed so that the barrier 60 installed at the inner surface of the supply duct 53 does not protrude from the inner surface of the heat exchange duct 52. In addition, the barrier groove may be formed so that the barrier 60 is spaced apart by a certain distance from the inner surface of the supply duct 53. The barrier groove may be formed at the inner surface of the supply duct 53.

The barrier groove may include an upper barrier groove 531, a side barrier groove 532, and lower barrier grooves 533*a* and 533*b*.

As shown in FIG. 11, the upper barrier groove 531 may be formed at the duct cover 50*b*. That is, the upper barrier groove 531 may be formed at a part of the dust cover 50*b* that corresponds to a supply duct body 53A, that is, a supply duct cover 53B. The upper barrier groove 531 may be formed at a whole of the supply duct cover 53B in a shape that corresponds to an upper surface of the supply duct body 53A.

At a bottom of the upper barrier groove 531, a plurality of fixing protrusions 67 may be provided. The plurality of fixing protrusions 67 may be protruded from the bottom of the upper barrier groove 531 to a certain height. Each of the plurality of fixing protrusions 67 may have the female screw formed.

The upper barrier 61 may be provided with a plurality of fixing holes 61*a* that correspond to the plurality of fixing protrusions 67 of the upper barrier groove 531. Accordingly, the upper barrier 61 may be fixed to the upper barrier groove 531 by using a plurality of bolts or screws. At this time, the upper barrier 61 may be spaced apart from the bottom of the upper barrier groove 531, that is, the upper surface of the supply duct 53, by the plurality of fixing protrusions 67.

As shown in FIG. 7, the side barrier groove 532 and the lower barrier grooves 533*a* and 533*b* may be formed at the side surface and the lower surface of the supply duct 53.

The side barrier groove 532 may be formed at a part of the duct body, that is, the supply duct body 53A, that form the supply duct 53. The side barrier groove 532 may be formed to correspond to a whole side surface area of the supply duct 53. That is, the side barrier groove 532 may be formed to be stepped with respect to the side surface of the heat exchange duct 52.

At a bottom of the side barrier groove 532, a plurality of fixing parts 64 may be provided. The plurality of fixing parts 64 may be provided at an upper end of the side barrier groove 532, that is, the upper end of the side surface of the supply duct body 53A. Each of the plurality of fixing parts 64 may have the female screw formed.

At an upper end of the side barrier 62, a plurality of fixing pieces 62*c* that correspond to the plurality of fixing parts 64 of the side barrier groove 532 may be provided. At each of the plurality of fixing pieces 62*c*, the fixing hole may be provided. Accordingly, the side barrier 62 may be fixed to the side barrier groove 532 by using the plurality of bolts or screws. At this time, the side barrier 62 may be spaced apart from the bottom of the side barrier groove 532, that is, the side surface of the supply duct 53, by the plurality of fixing parts 64.

The lower barrier groove may be formed at a part of the duct body 50*a* that form the supply duct 53, that is, the supply duct body 53A. The lower barrier groove may be formed to correspond to a whole lower surface area of the supply duct 53. That is, the lower barrier groove may be formed to be stepped with respect to the lower surface 52*c* of the heat exchange duct 52.

The lower barrier groove may include a horizontal barrier groove 533*a* which is formed to correspond to the horizontal surface 53*c*1 of the supply duct 53 and an inclined barrier groove 533*b* which is formed to correspond to the lower inclined surface 53*c*2 of the supply duct 53.

At a bottom of the lower barrier groove, a plurality of fixing protrusions 65 may be provided. For example, the plurality of fixing protrusions 65 may be provided at the horizontal barrier groove 533*a*. The plurality of fixing protrusions 65 may be protruded from the bottom of the lower barrier groove to a certain height. Each of the plurality of fixing protrusions 65 may have the female screw formed.

The lower barrier 63 may be provided with a plurality of fixing holes 63*c* that correspond to the plurality of fixing protrusions 65 of the lower barrier groove. Accordingly, the lower barrier 63 may be fixed to the lower barrier groove by using the plurality of bolts or screws. At this time, the lower barrier 63 may be spaced apart from the bottom of the lower barrier groove, that is, the lower surface of the supply duct 53, by the plurality of fixing protrusions 65.

At the inclined barrier groove 533*b* of the lower barrier groove, the fixing boss 66 for fixing the heater bracket 90 may be provided. The fixing boss 66 may have the female screw formed. The lower barrier 63 may be formed to have a through-hole through which the fixing boss 66 is inserted.

Accordingly, when the lower barrier 63 is installed at the lower barrier groove, the fixing boss 66 may be protruded to the upper side of the lower barrier 63. Then, the heater bracket 90 may be fixed to the fixing boss 66 by using a bolt or a screw.

As described above, when the barrier 60 is installed at the inside of the supply duct 53, the barrier 60 may block the heat that is generated by the heater 80. Accordingly, the supply duct 53 may be prevented from being deformed or ignited by the heat of the heater 80.

In the above description, the inlet duct 51, the heat exchange duct 52, and the supply duct 53 are formed as one body, but in another embodiment, the inlet duct 51, the heat exchange duct 52, and the supply duct 53 may be formed separately.

In this case, the inlet duct 51, the heat exchange duct 52, and the supply duct 53 may be respectively formed with a body of which the upper surface is opened and a cover which covers the upper surface of the body like the upper duct 50 described above.

For example, the inlet duct 51 may be formed with an inlet duct body of which the upper surface is opened and an inlet duct cover which covers the upper surface thereof. The heat exchange duct 52 may be formed with a heat exchange duct body of which the upper surface is opened and a heat exchange duct cover which covers the upper surface thereof. In addition, the supply duct 53 may be formed with the supply duct body 53A of which the upper surface is opened and the supply duct cover 53B which covers the upper surface thereof.

When forming as described above, the supply duct cover 53B, the heat exchange duct cover, and the inlet duct cover may be individually opened. That is, the heater 80 may be installed at the supply duct body 53A by opening the supply duct cover 53B. In addition, the evaporator 73 and the condenser 72 may be installed at the heat exchange duct body by opening the heat exchange duct cover. In addition, lint caught in the lint filter 42 may be removed by opening the inlet duct cover.

A drying cycle of the washing machine with drying function 1 according to an embodiment having the structure as described above will be described in detail below.

Because the washing machine with drying function 1 according to an embodiment may perform a washing cycle, a rinsing cycle, a spin drying cycle, and the like as same as a washing machine of the related art, descriptions thereof are omitted.

When the drying cycle is started, the processor of the washing machine 1 may operate the blower fan 41, the compressor 71 of the heat exchange part 70, and the heater 80.

When the compressor 71 is operated, the refrigerant may circulate through the compressor 71, the condenser 72, the expansion valve 74, and the evaporator 73. At this time, the evaporator 73 and the condenser 72 may be installed at the heat exchange duct 52, and the condenser 72 may be installed at a downstream of the evaporator 73 in the circulating direction of air.

When the blower fan 41 is operated, the air inside the drum 30 may circulate through the back duct 55, the inlet duct 51, the heat exchange duct 52, a discharge duct 53, the blower fan 41, and the blow duct 54, thereby drying the laundry.

For example, the humid air in the drum 30 may be discharged into a space between a back surface plate 32 of the drum 30 and the back surface plate 22 of the tub 20 through the plurality of through-holes of the back surface plate 32 of the drum 30. The humid air that is discharged between the back surface plate 32 of the drum 30 and the back surface plate 22 of the tub 20 may be introduced into the back duct 55 through the back opening 22*a* of the tub 20.

The humid air introduced into the back duct 55 may be discharged to the inlet duct 51 through the outlet 55*b*.

The humid air A1 introduced into the inlet 51*a* of the inlet duct 51 may flow in a direction perpendicular to the front surface cover 11 of the cabinet 10, that is, the front surface 21 of the tub 20. The humid air introduced into the inlet duct 51 may be discharged to the heat exchange duct 52 through the lint filter 42. At this time, foreign material such as the lint contained in the humid air may be filtered by the lint filter 42.

The humid air introduced into the inlet 52*a* of the heat exchange duct 52 may flow in a direction parallel to the front surface cover 11 of the cabinet 10. That is, air A2 that flows through the heat exchange duct 52 may form a right-angle with air A1 that flows through the inlet duct 51.

The humid air introduced into the inlet 52*a* of the heat exchange duct 52 may pass the evaporator 73 to remove moisture. The air from which the moisture was removed may be heated while passing the condenser 72. Accordingly, from the outlet 52*b* of the heat exchange duct 52, the dried air in high temperature may be discharged into the supply duct 53.

The dried air in high temperature introduced into the inlet 53*a* of the supply duct 53 may flow in a direction perpendicular to the front surface cover 11 of the cabinet 10. That is, air A3 that flows through the supply duct 53 may form a right-angle with the air A2 that flows through the heat exchange duct 52, and may be in parallel with the air A1 that flows through the inlet duct 51.

The air introduced into the supply duct 53 may be heated by the heater 80. The heater 80 may heat the air introduced into the supply duct 53 at an initial stage of the drying cycle, that is, before the heat exchange part 70 heats the air to greater than or equal to 90 degrees (° C.). When preheating of the heat exchange part 70 is completed, the heater 80 may be turned-off, and the air may only be heated by the heat exchange part 70.

The air that is discharged from the outlet 53*b* of the supply duct 53 may be introduced into the suction hole of the blower fan 41, that is, the inlet 54*a* of the blow duct 54. At this time, because the outlet 53*b* of the supply duct 153 and the inlet 54*a* of the blow duct 54 are disposed in a straight line, the flow resistance of air that is introduced into the blower fan 41 may be minimized.

The blow duct 54 may discharge the dried air in high temperature suctioned into the inlet 54*a* downward to the diaphragm 25 through the outlet 54*b*. At this time, the direction of air that is discharged from the outlet 54*b* of the blow duct 54 may form a right-angle with the direction of air that is suctioned into the inlet 54*a*.

The dried air in high temperature from the outlet 54*b* of the blow duct 54 may be introduced into the inside of the diaphragm 25 through the connecting part 26. At this time, because the outlet 54*b* of the blow duct 54 and the connecting part 26 are disposed in a straight line, the dried air in high temperature that is discharged by the blower fan 41 may be introduced into the inside of the diaphragm 25 in a straight line.

Because the diaphragm 25 is in communication with the drum opening 31*a* provided at the front surface 31 of the drum 30, the dried air in high temperature may be introduced into the inside of the drum 30 through the diaphragm 25.

The dried air in high temperature introduced into the inside of the drum 30 may dry the laundry by contacting the laundry. The dried air in high temperature may become humid air in low temperature due to the drying of the laundry.

The humid air in the drum 30 may continue the above-described circulation by being discharged to the back duct 55 through the plurality of through-holes of the back surface plate 32 of the drum 30.

The washing machine with drying function according to an embodiment as described above may reduce drying time by installing the heater in the supply duct.

Figure 14:
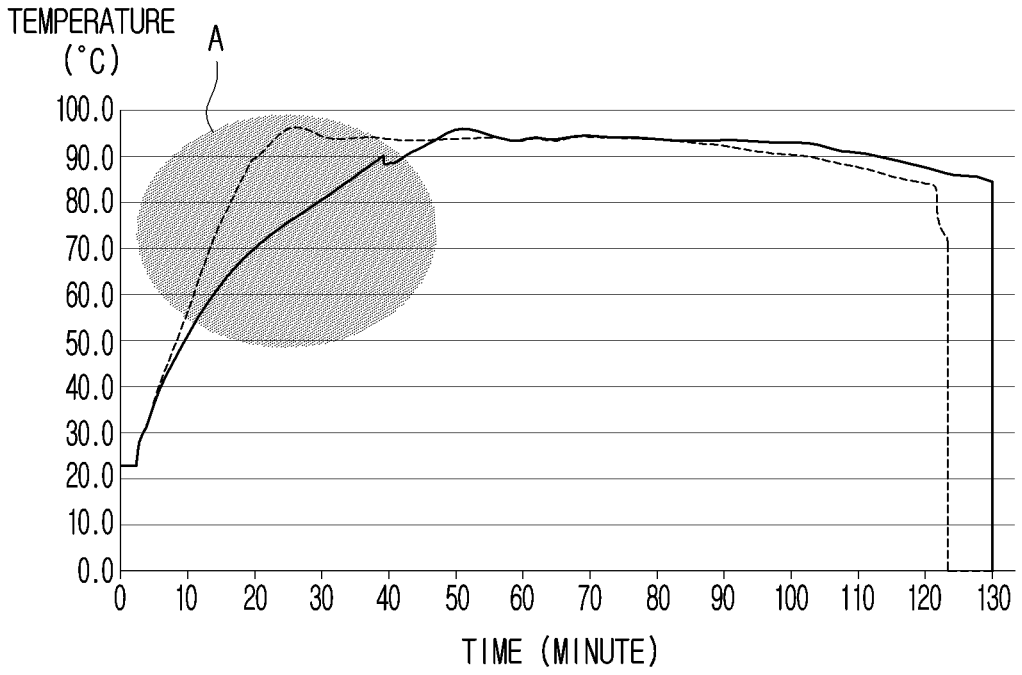
FIG. 14 is a graph comparing drying times of a washing machine with drying function according to an embodiment and a washing machine with drying function without a heater.

FIG. 14 is a graph comparing drying times of a washing machine with drying function according to an embodiment and a washing machine with drying function without a heater.

In FIG. 14, a vertical axis may represent temperature, and a unit may be ° C. A horizontal axis may represent time, and a unit may be minutes (Min). In addition, a dotted line represents a drying time of the washing machine with drying function according to an embodiment. A solid line represents a drying time of the washing machine with drying function without the heater.

The washing machine with drying function without the heater is the washing machine with drying function according to an embodiment from which only the heater is removed. That is, the washing machine with drying function without the heater may have the same structure as the washing machine with drying function according to an embodiment except for the heater.

Referring to FIG. 4, the drying time of the washing machine with drying function according to an embodiment may be reduced by about 10 minutes compared to the drying time of the washing machine with drying function without the heater.

A temperature rising time during which the temperature of air that is supplied to the drum reaches 90 degrees in the washing machine with drying function according to an embodiment may be short compared to the temperature rising time during which the temperature of air that is supplied to the drum reaches 90 degrees in the washing machine with drying function without the heater (see part A in FIG. 14).

In FIG. 14, the temperature rising time of the washing machine with drying function according to an embodiment may be about 20 minutes, but the temperature rising time of the washing machine with drying function without the heater is about 40 minutes.

The washing machine with drying function according to an embodiment may have a short temperature rising time because the heater heats the air while the compressor is being preheated, but the washing machine with drying function without the heater has a relatively long temperature rising time because the air is not heated while the compressor is being preheated.

Accordingly, the washing machine with drying function according to an embodiment may have a drying function that substantially equals a drying-only dryer.

In addition, the washing machine with drying function according to an embodiment may prevent drying performance of the washing machine with drying function from deteriorating at winter because the heater heats the air while the compressor is being preheated.

In general, because ambient temperature drops to below zero at winter, the drying time of the washing machine with drying function increases compared to when ambient temperature is above zero. This occurs because the time it takes for the compressor of the washing machine with drying function to be preheated may take longer. Accordingly, the drying performance of the washing machine with drying function may be deteriorated at winter.

However, in the case of the washing machine with drying function according to an embodiment, the drying time may be reduced because the heater heats the air while the compressor is being preheated. Accordingly, the washing machine with drying function according to an embodiment may prevent the drying performance from being deteriorated at winter.

While the disclosure has been illustrated and described with reference to various example embodiments thereof, it will be understood that the various example embodiments are intended to be illustrative, not limiting. It will be understood by those skilled in the art that various changes in form and details may be made therein without departing from the true spirit and full scope of the disclosure, including the appended claims and their equivalents.

What is claimed is:

1. A washing machine with drying function, comprising:
- a cabinet having a laundry insertion hole at a front surface of the cabinet;
- a tub, inside the cabinet, having a front opening so that laundry is insertable through the laundry insertion hole and then through the front opening to be received into the tub, and a back opening;
- a drum rotatably disposed inside the tub; and
- a heated air supplying device above the tub and comprising:
  - an evaporator,
  - a condenser,
  - a heater,
  - a heat exchange duct in which the evaporator and the condenser are disposed,
  - an inlet duct at one side of the heat exchange duct,
  - a supply duct at an opposite side of the heat exchange duct than the inlet duct and in which the heater is disposed, and
  - a blower fan at a front side of the tub,
  - wherein the heat exchange duct, the inlet duct, the supply duct, and the blower fan are configured so that air from the back opening of the tub is introduced into the inlet duct and is guided by the inlet duct, the air guided by the inlet duct is received by the heat exchange duct and then passes through the heat exchange duct in a lateral direction of the tub, the air passed through the heat exchange duct is received by the supply duct and discharged by the supply duct in a direction toward a front side of the tub, and the blower fan forms an airflow that causes the air discharged from the supply duct to be supplied to the front opening.

2. The washing machine with drying function of claim 1, wherein the heater is fixed to a side surface of the supply duct.

3. The washing machine with drying function of claim 2, further comprising:
- a heater bracket that is installed on a lower surface of the supply duct and that supports the heater.

4. The washing machine with drying function of claim 1, further comprising:
- a barrier on an inner surface of the supply duct.

5. The washing machine with drying function of claim 4, further comprising:
- a barrier groove on the inner surface of the supply duct, and
- wherein the barrier is configured to be installed in the barrier groove.

6. The washing machine with drying function of claim 4, wherein the barrier comprises:
- an upper barrier covering an upper surface of the supply duct;
- a side barrier covering a side surface of the supply duct; and
- a lower barrier covering a lower surface of the supply duct.

7. The washing machine with drying function of claim 4, wherein the barrier is spaced apart from the inner surface of the supply duct.

8. The washing machine with drying function of claim 4, wherein the barrier comprises a metal material.

9. The washing machine with drying function of claim 1, wherein the heater comprises a sheath heater.

10. The washing machine with drying function of claim 1, wherein the supply duct comprises:
- a supply duct body to which the heater is installed; and
- a supply duct cover covering an upper surface of the supply duct body and that is separable from the supply duct body.

11. A washing machine with drying function, comprising:

a cabinet having a laundry insertion hole at a front surface of the cabinet;

a cylindrical tub, inside the cabinet, having a front opening so that laundry is insertable through the laundry insertion hole and then through the front opening to be received into the tub, and a back opening;

a diaphragm connecting the laundry insertion hole with the front opening of the tub;

a drum rotatably disposed inside the tub; and a heated air supplying device comprising:

an evaporator, a condenser, a heat exchange duct in which the evaporator and the condenser are disposed, an inlet duct at one side of the heat exchange duct, a supply duct at an opposite side of the heat exchange duct than the inlet duct, a barrier on an inner surface of the supply duct, a heater inside the supply duct and spaced apart from the barrier, and a blow duct at a front side of the tub connecting the supply duct to the diaphragm, wherein the heat exchange duct, the inlet duct, the supply duct, and the blow duct are configured so that air from the back opening of the tub is introduced into the inlet duct and is guided by the inlet duct, the air guided by the inlet duct is received by the heat exchange duct and then passes through the heat exchange duct in a lateral direction of the tub, the air passed through the heat exchange duct is received by the supply duct and discharged by the supply duct in a direction toward a front side of the tub.

12. The washing machine with drying function of claim 11, further comprising:

a heater bracket that is installed on a lower surface of the supply duct and that supports the heater.

13. The washing machine with drying function of claim 11, further comprising:

a barrier groove on an inner surface of the supply duct and to which the barrier is fixed.

14. The washing machine with drying function of claim 13, wherein the barrier is spaced apart from a bottom of the barrier groove.

15. The washing machine with drying function of claim 11, wherein the barrier comprises:

an upper barrier covering an upper surface of the supply duct;

a side barrier covering a side surface of the supply duct; and a lower barrier covering a lower surface of the supply duct.

* * * * *